US008368732B2

(12) United States Patent
Matsushima et al.

(10) Patent No.: US 8,368,732 B2
(45) Date of Patent: Feb. 5, 2013

(54) THERMAL PRINTER

(75) Inventors: Gen Matsushima, Kiyose (JP); Yasuyuki Mori, Higashikurume (JP); Katsutoshi Mukaijima, Higashikurume (JP)

(73) Assignees: Citizen Holdings Co., Ltd., Tokyo (JP); Citizen Systems Japan Co., Ltd., Tokyo (JP)

( * ) Notice: Subject to any disclaimer, the term of this patent is extended or adjusted under 35 U.S.C. 154(b) by 221 days.

(21) Appl. No.: 13/023,773

(22) Filed: Feb. 9, 2011

(65) Prior Publication Data

US 2011/0193925 A1 Aug. 11, 2011

(30) Foreign Application Priority Data

Feb. 10, 2010 (JP) ..... 2010-027828

(51) Int. Cl.
*B41J 2/335* (2006.01)

(52) U.S. Cl. ..... 347/197

(58) Field of Classification Search ..... 347/197, 347/198, 177, 218, 222; 400/120.16, 120.17, 400/188

See application file for complete search history.

(56) References Cited

U.S. PATENT DOCUMENTS

| | | | | |
|---|---|---|---|---|
| 5,694,159 | A * | 12/1997 | Kajiya et al. | 347/197 |
| 7,145,585 | B2 * | 12/2006 | Sogabe | 347/222 |
| 7,500,797 | B2 * | 3/2009 | Boisdon et al. | 347/197 |
| 7,517,165 | B2 * | 4/2009 | Suzuki et al. | 347/222 |

FOREIGN PATENT DOCUMENTS

| | | |
|---|---|---|
| JP | 2006-315285 | 11/2006 |
| JP | 2009-101524 | 5/2009 |

* cited by examiner

*Primary Examiner* — Kristal Feggins
(74) *Attorney, Agent, or Firm* — Wenderoth, Lind & Ponack, L.L.P.

(57) ABSTRACT

A thermal printer includes a body detachably including a platen roller unit having a platen roller, and a cover element movable relative to the body between an open position and a closed position, detachably including a thermal printhead unit. The cover element further includes a claw protruding backward, a stepped pin extending downward, including a step portion at a bottom end, and a stepped pin adjuster element. The thermal printhead unit includes an exothermic element array, a supported portion to be hooked on the claw, and a notch portion to be hooked on the step portion. The platen roller unit and the thermal printhead unit include respective positioning elements which engage with each other to restrict a relative movement of the exothermic element array and the platen roller while the cover element is in a closed position.

6 Claims, 22 Drawing Sheets

VIEW.D

VIEW.E

VIEW.D

VIEW.E

VIEW.F

DETAIL.G

THERMAL PRINTER

CROSS REFERENCE TO RELATED APPLICATION

The present application is based on and claims priority from Japanese Patent Application No. 2010-27828, flied on Feb. 10, 2010, the disclosure of which is hereby incorporated by reference in its entirety.

BACKGROUND OF THE INVENTION

1. Field of the Invention

The present invention relates to a thermal printer, in particular, to an improvement in the structures of a thermal printhead unit and a platen roller unit.

2. Description of the Prior Art

A thermal printer is configured to include a thermal printhead to print information on a thermal paper. In order to realize high-quality printing, it is essential to tightly place a paper into contact with an exothermic element array of the thermal printhead. A platen roller is provided to press the paper onto the exothermic element array.

Meanwhile, various kinds of papers are available for the thermal printer, and it is well known that the level of contact with the exothermic element array differs depending on the thickness of a paper.

For example, with use of a thin paper, it is possible to bring the paper in close contact with an appropriate portion of the exothermic element array for proper printing. However, with use of a thick paper, it may not be able to bring the paper in close contact with an appropriate portion of the exothermic element array owing to a large rigidity of the thick paper in addition to a displacement of the thermal printhead.

In view of solving the above problem, Japanese Patent Application Publication No. 2006-315285 and No. 2009-101524 disclose a thermal printer with a thermal printhead whose position is changeable in accordance with the thickness of a paper in use, to be able to adjust a positional relation between the exothermic element array and the paper and properly place the paper in close contact with the exothermic element array even with use of a thick paper.

Specifically, in the thermal printer of the above documents the thermal printhead is configured to be movable relative to the platen roller between two different positions in a circumference direction of the platen roller. With such a configuration, it aims to constantly maintain the position of the exothermic element array relative to the rotary axis of the platen roller irrespective of the thickness of a paper by moving the thermal printhead forward/backward in the paper forwarding direction according to the thickness of the paper.

However, in reality, the position of the exothermic element array tightly contacting with the paper shifts depending on the thickness of the paper due to rigidity of the paper which increases in accordance with the thickness.

Therefore, a problem arises with the thermal printer disclosed in the above documents that the exothermic element array cannot be brought into a close contact with a paper in a large thickness.

Furthermore, the thermal printhead and the platen roller are preferably configured to be manually attachable/detachable easily for replacement without use of any tool, in order to reduce time and labor taken for detaching/attaching them.

Moreover, generally, a body of the thermal printer is provided with a cover element to open/close for the purpose of replenishing or replacing a paper. It is configured that with the cover element open, a paper can be set in a paper container in the body.

The thermal printer is therefore preferably configured to include the platen roller in the body and the thermal printhead on the cover element and to easily complete paper setting to place a top end of the paper between the platen roller and the thermal printhead by simply closing the cover element.

SUMMARY OF THE INVENTION

The present invention aims to provide a thermal printer which comprises a thermal printhead and a platen roller separately that are easily detachable and can properly bring an exothermic element array in close contact with a paper in use depending on the thickness of the paper.

According to one aspect of the present invention, a thermal printer comprises a body comprising a platen roller unit including a platen roller; and a cover element being movable between an open position and a closed position relative to the body and comprising a thermal printhead unit, a claw protruding backward, a stepped pin extending downward, including a step portion at a bottom end, and a stepped pin adjuster element moving the stepped pin in an axial direction to change a position of the step portion, the thermal printhead unit including an exothermic element array, a supported portion in a portion in front of the exothermic element array to be hooked on the claw, and a notch portion at about a center of a width direction of a portion behind the exothermic element array to be hooked on the step portion of the stepped pin, wherein: the platen roller unit and the thermal printhead unit are placed in the body and the cover element, respectively so that the exothermic element array contacts with the platen roller while the cover element is in the closed position and the exothermic element array and the platen roller are separated from each other while the cover element is not in the closed position; the platen roller unit and the thermal printhead unit include respective positioning elements which engage with each other to restrict a relative movement of the exothermic element array and the platen roller while the cover element is in the closed position; and the platen roller unit is configured to be detachable from the body in a direction coinciding with a moving direction of the cover element from the closed position.

BRIEF DESCRIPTION OF THE DRAWINGS

Features, embodiments, and advantages of the present invention will become apparent from the following detailed description with reference to the accompanying drawings:

FIG. 6A is a perspective view thereof, FIG. 6B is a side view thereof with a spring extended, seen from the arrow A in FIG. 6A, and FIG. 6C is a side view thereof with a spring contracted, seen from the arrow A;

FIG. 9A shows the same corresponding to FIG. 5A, FIG. 9B shows the same without any vertical inclination seen from the arrow C in FIG. 9A, and FIGS. 9C, 9D show the same with a vertical inclination at either side in a width direction seen from the arrow C;

DETAILED DESCRIPTION OF THE PREFERRED EMBODIMENTS

Hereinafter, an embodiment of the present invention will be described in detail with reference to the accompanying drawings.

Figure 1:
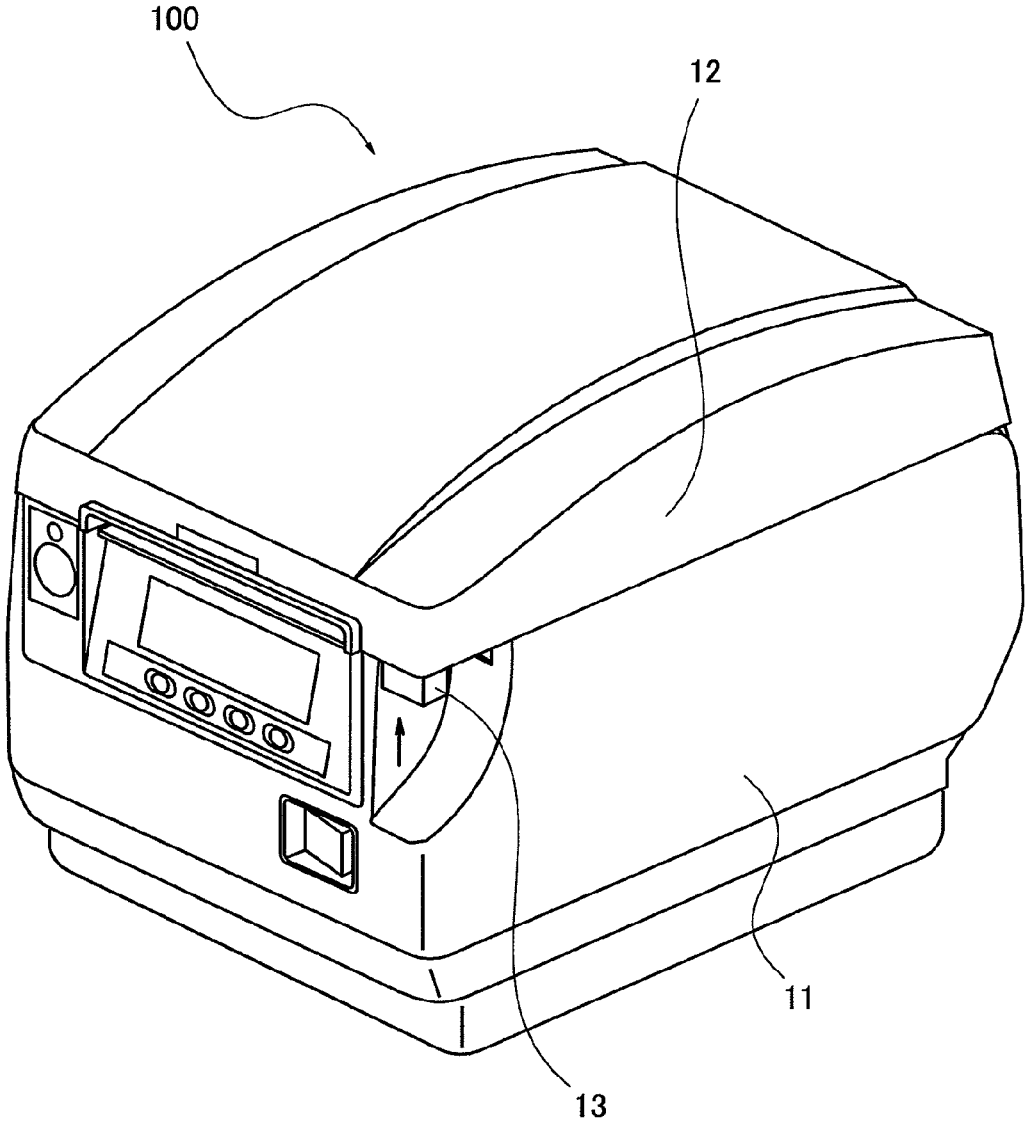
FIG. 1 shows the exterior of a thermal printer in normal use according to one embodiment of the present invention.

FIG. 1 shows the exterior of a thermal printer 100 in normal use according to one embodiment of the present invention. The thermal printer 100 comprises a body 11 and a cover element 12 which is rotated around the back end of the body 11 from upward to backward to open, as shown in FIG. 2.

Figure 2:
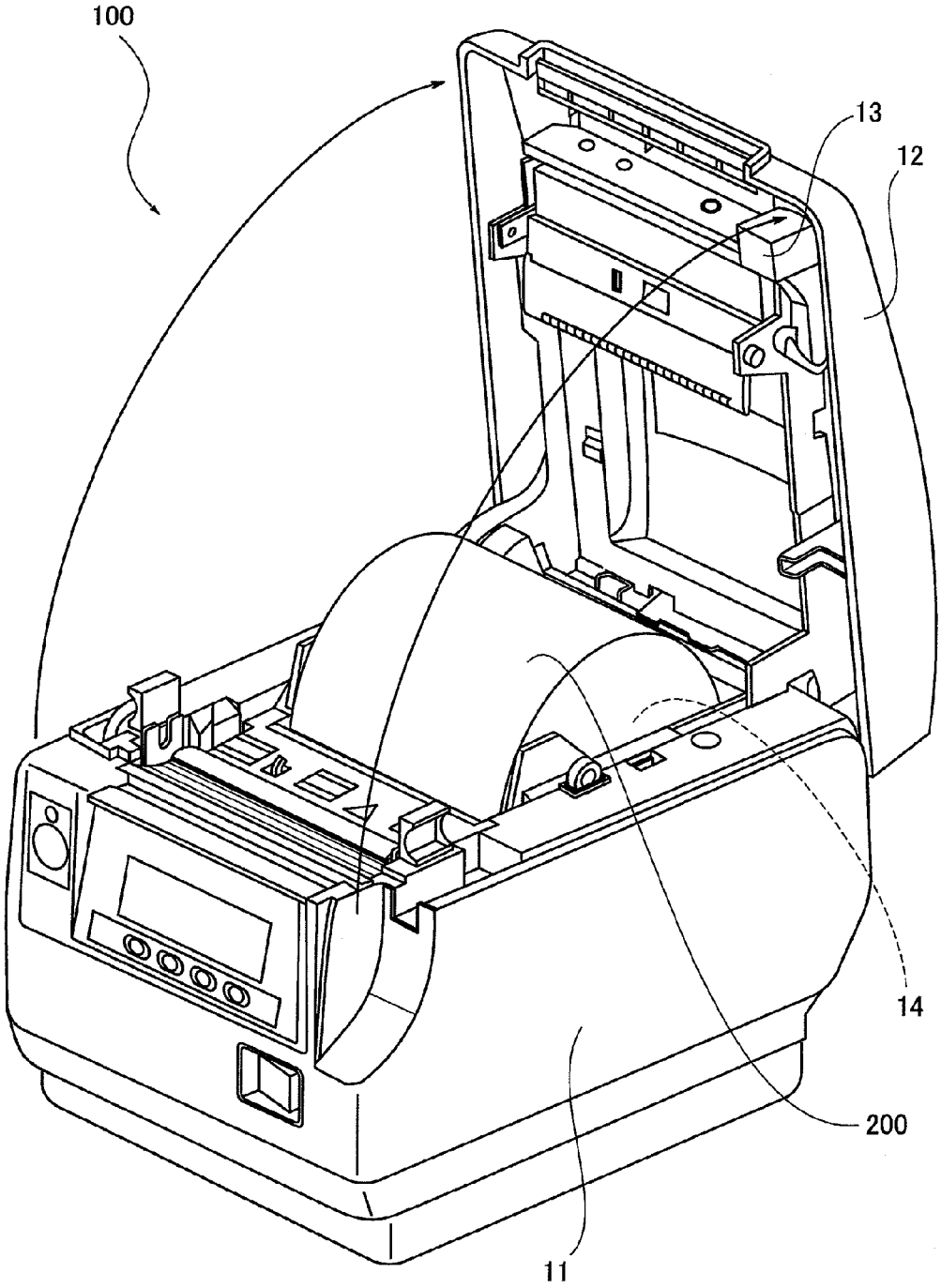
FIG. 2 shows the thermal printer in FIG. 1 with a cover element open.

The cover element 12 is biased to an open position by a not-shown coil spring in FIG. 2 while it is retained in a closed position against a bias force of the coil spring by a not-shown hook of the body 11 fitted into the cover element 12 in FIG. 1.

The hook of the body 11 is removed from the cover element 12 by pressing a lever 13 of the cover element 12 to the arrow direction (upward) in FIG. 1, thereby moving the cover element 12 to the open position by a bias force of the coil spring in FIG. 2.

Figure 3:
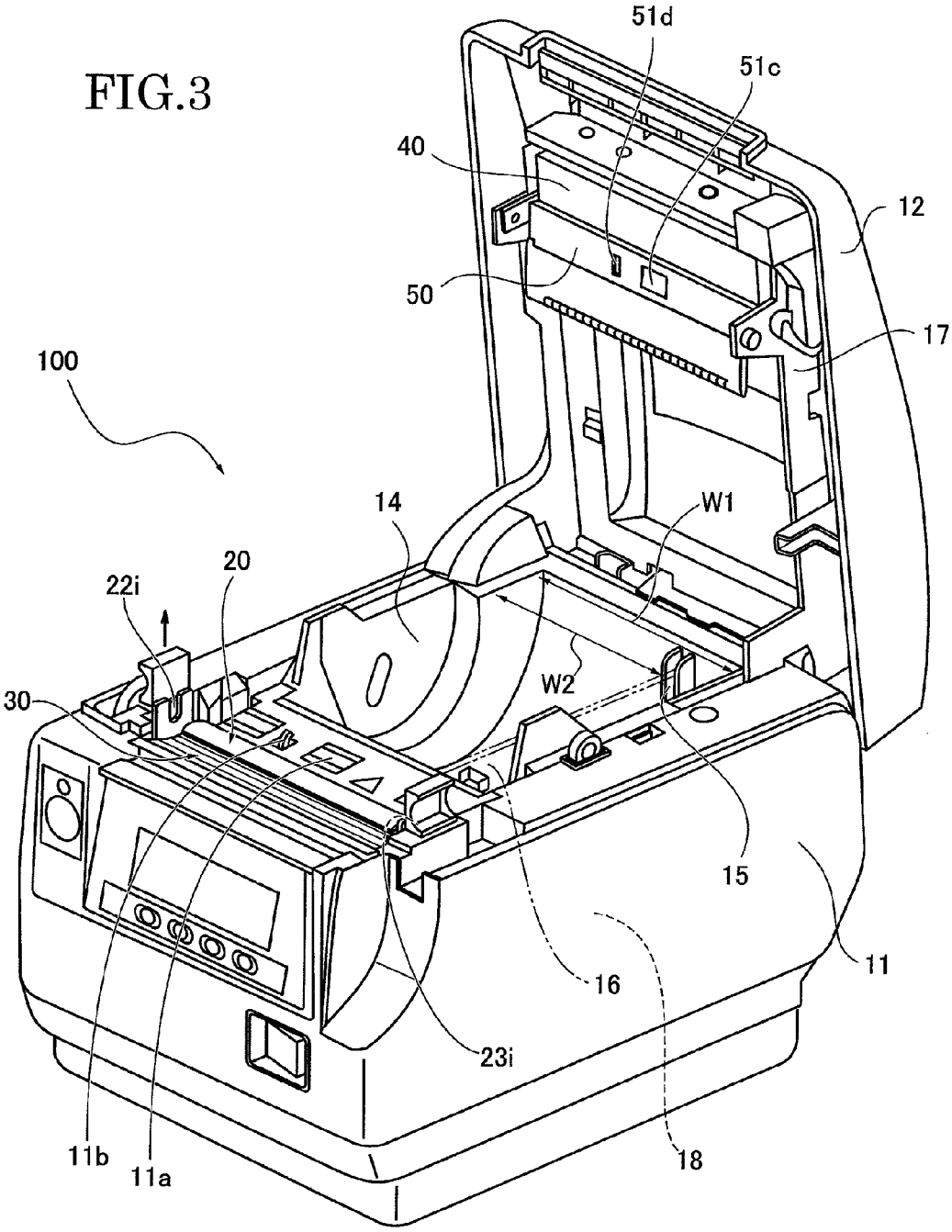
FIG. 3 shows the thermal printer in FIG. 2 with a thermal paper removed.

As shown in FIG. 2, the thermal printer 100 comprises a paper container 14 in which a roll of thermal paper 200 as a printing medium is accommodated. FIG. 3 shows the thermal printer 100 without the thermal paper 200.

The paper container 14 includes a plate groove 15 at a predetermined position in a width direction to support a detachable partition plate 16 of an almost half-round shape (indicated by double-dashed lines in FIG. 3).

While the partition plate 16 is held in the plate groove 15, a space in a narrow width W2 (FIG. 3) from one sidewall is usable in the paper container 14 to accommodate a thermal paper 200 in the narrow width W2. Meanwhile, while the partition plate 16 is not held in the plate groove 15, a space in a wide width W1 (FIG. 3) from one sidewall to another is usable in the paper container 14 to accommodate a thermal paper 200 in the wide width W1. Thus, the width of the thermal paper 200 for use can be selected in accordance with use/non-use of the partition plate 16.

The body 11 further comprises a platen roller unit 20 and a cutter unit 30 detachably.

Being pulled up in the arrow direction (upward in FIG. 3, the moving direction of the cover element 12 from the closed position), the platen roller unit 20 and the cutter unit 30 can be detached from the body 11. Attachment of the platen roller unit will be later described in detail.

The cover element 12 detachably comprises a thermal printhead unit 40 including a later-described exothermic element array 42 and a head cover damper unit 50.

The thermal printhead unit 40 and the platen roller unit 20 are configured that with the cover element 12 in a closed position, the exothermic element array 42 contacts with a later-described platen roller 21 of the platen roller unit 20 while with the cover element 12 moved from the closed position to an open position, the exothermic element array 42 and the platen roller 21 are separated from each other.

An outer package of the thermal printer according to the present embodiment is made of a resin and a framework thereof is made of a metal. The thermal printhead unit 40 and head cover damper unit 50 are mounted on a cover frame 17 of the cover element 12 and manually detachable without any tool.

Figure 4:
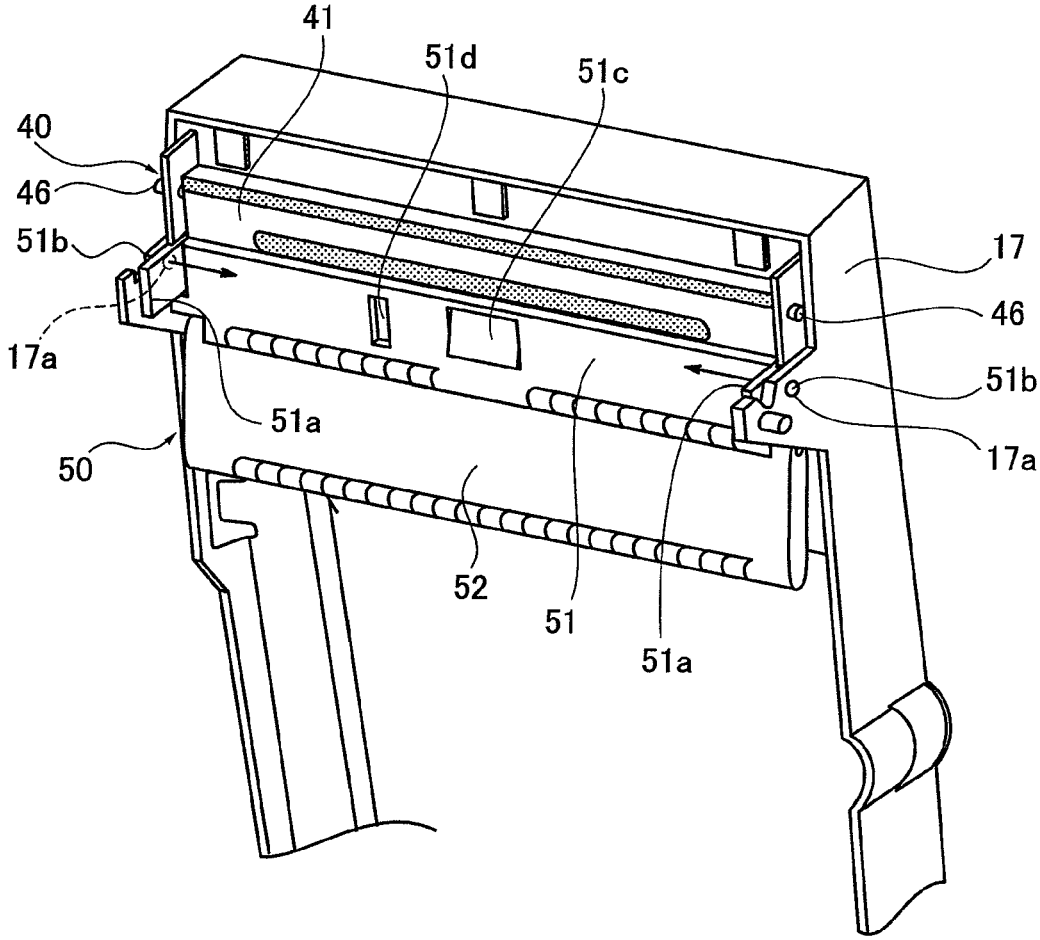
FIG. 4 shows a frame of the cover element to which a thermal printhead unit and a head cover damper unit are attached.

Specifically, the thermal printhead unit 40 is mounted on the cover frame 17 and the head cover damper unit 50 is then attached to the cover frame 17 so as to partially cover the thermal printhead unit 40 as shown in FIG. 4.

The head cover damper unit 50 is integrally comprised of a head cover 51 partially covering the thermal printhead 41 of the thermal printhead unit 40 for protection and a damper 52 applying a tension to the thermal paper 200. The head cover 51 comprises, on both sides, two elastic arms 51*a* with protrusions 51*b* and the protrusions 51*b* are fitted into holes 17*a* formed in predetermined positions of the cover frame 17 to attach the head cover damper unit 50 to the cover frame 17.

By elastically deforming both of the elastic arms 51*a* internally in the width direction of the head cover damper unit 50, the protrusions 51*a* are released from the holes 17*a*, making it possible to manually detach the head cover damper unit 50 from the cover frame 17 (FIG. 5A, 5B) without any tool.

Figure 6A:
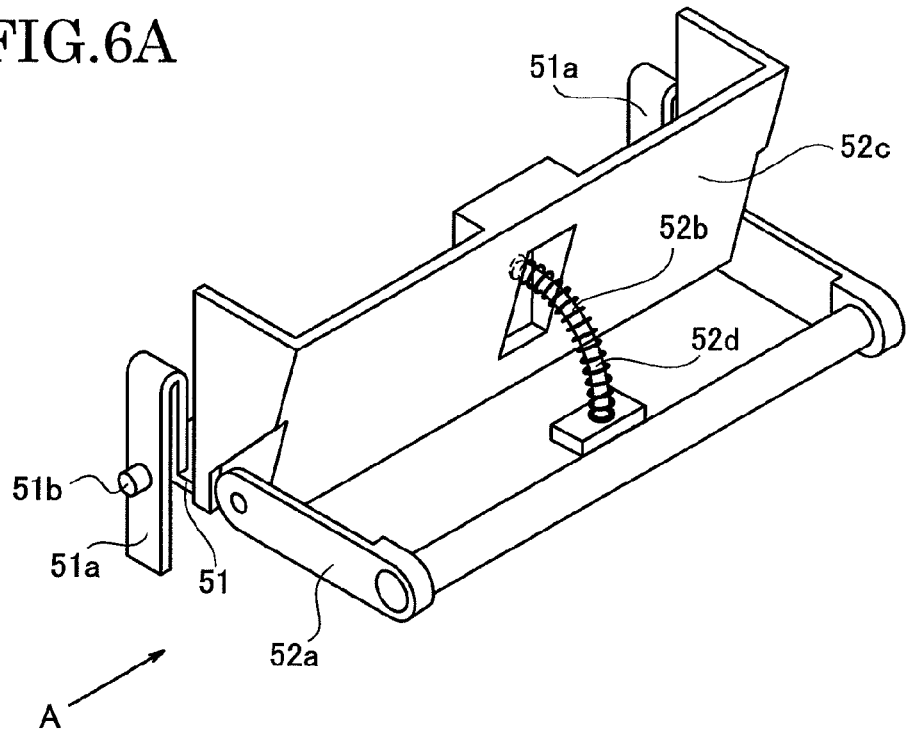
FIGS. 6A to 6C show the structure of the head cover damper unit in detail.
Figure 6B:
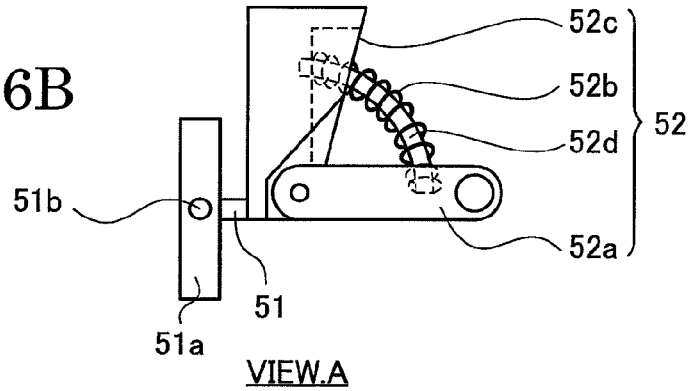
Figure 6C:
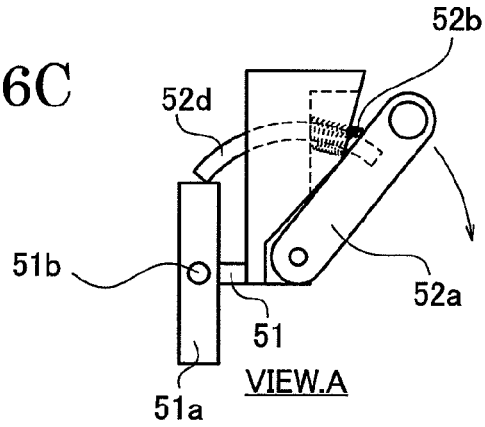

The detached head cover damper unit 50 is provided with a spring 52*b* between a damper plate 52*a* and a support plate 52*c* of the damper 52. The damper plate 52*a* is pressed down in the drawings, being applied with a bias force as an elastic restoring force of the spring 52*b* in accordance with a state of the spring 52*b* from extending when given a preload (FIG. 6B) and to contracting (FIG. 6C).

Also, the bias force pressing down the plate 52*a* provides a tension to the thermal paper 200 (not shown in FIGS. 6A to 6C) contacting with the bottom face of the damper 52.

An arc-like core rod 52*d* is inserted into the spring 52*b* and functions as a guide to prevent the spring 52*b* from bending in an unintended direction.

Figure 5A:
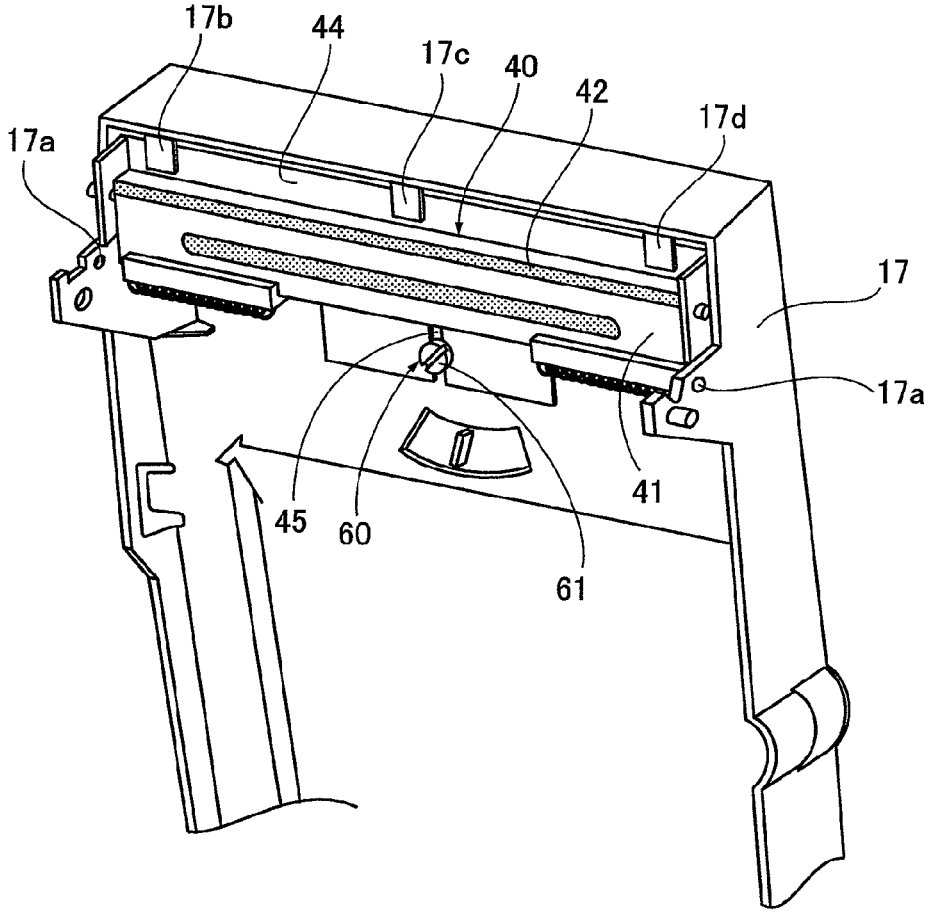
FIG. 5A shows the frame of the cover element with the head cover damper unit removed.
Figure 5B:
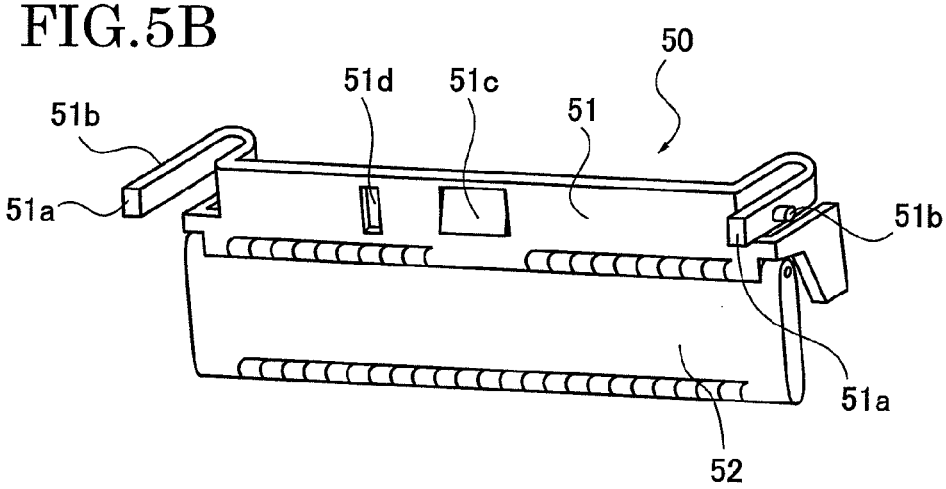
FIG. 5B shows a removed head cover damper unit.

The head cover 51 of the head cover damper unit 50 comprises a photo sensor 51*c* detecting light and a lever hole 51*d* to release a paper detection lever 11*b* (FIG. 5B).

Meanwhile, the body 11 comprises a light source 11*a* at a position facing the photo sensor 51*c* and the paper detection lever 51*d* at a position facing the lever hole 51*d* when the cover element is closed.

The paper detection lever 11*b* is biased to protrude as shown in FIG. 3. Given a downward load, it is rotated to move down against the bias force. Presence or absence of the thermal paper 200 is determined based on presence or absence of this movement of the lever 11*b*.

Specifically, with the cover element 12 closed and the thermal paper 200 placed on the paper detection lever 11*b*, the thermal paper 200 presses down the paper detection lever 11*b* and applies a load thereto to rotate down against the bias force. Thereby, presence of the thermal paper 200 is detected.

Oppositely, with no thermal paper 200 placed on the paper detection lever 11*b*, the lever 11*b* is inserted into the lever hole 51*d* and free from a load against the bias force. Accordingly, it is not rotated down so that absence of the thermal paper 200 is detected.

Further, with use of a paper on which a thermal label as a printing subject is adhered, the light source 11*a* and the photo sensor 51*c* are provided to distinctly identify a label portion and a paper portion from the paper traveling therebetween.

That is, light emitted from the light source 11*a* partially transmits through the paper and reaches the photo sensor 51*c*. The photo sensor 51*c* is configured to detect intensity of transmitted light and compare the intensity with a preset threshold (a value to distinguish optical intensity having transmitted through the label portion and one having transmitted through the paper portion). With the intensity being the threshold or more, the photo sensor 51*a* determines that the paper in question is a paper portion while with the intensity being less than the threshold, it determines that the paper in question is a label portion.

Thus, in thermal printing using a type of paper on which label portions are adhered, it is made possible to print not on the paper portions but on the label portions based on information obtained by the light source 11*b* and the photo sensor 51*c* without fail.

Further, the head cover damper unit 50 is detachable from the cover frame 17 as described above and can be manually attached thereto (FIG. 4) without any tool by elastically deforming both of the elastic arms 51*a* internally in the width direction of the head cover damper unit 50 to fit the protrusions 51*a* into the holes 17*a*.

Also, in the head cover damper unit 50, the damper 52 is configured of the damper 52 applying a tension to the thermal paper 200 and the head cover 51 partially covering the thermal printhead 41 integrally. This allows the damper 52 to apply a tension to the thermal paper 200 in the vicinity of the thermal printhead 41. In comparison with the one applying a tension to the thermal paper 200 at a position far away from the thermal printhead 41, the damper 52 can more properly apply a tension to the thermal paper 200 traveling on the thermal printhead 41.

Moreover, as shown in FIG. 5A, the thermal printhead unit 40 comprises, at a front end and in front of the element array, a supported portion 44 to fit into three claws 17*b*, 17*c*, 17*d* of the cover frame 17, and a notch portion 45 at about the center of a width direction of the cover element 12 and in the back of the exothermic element array to fit into a step portion 61 of a stepped pin 60 of the cover frame 17. The claws are configured to protrude backward. The stepped pin 60 extends downward (when the cover element 12 in the closed position) from the cover frame 17 and comprises the step portion 61 at a bottom end.

Figure 7A:
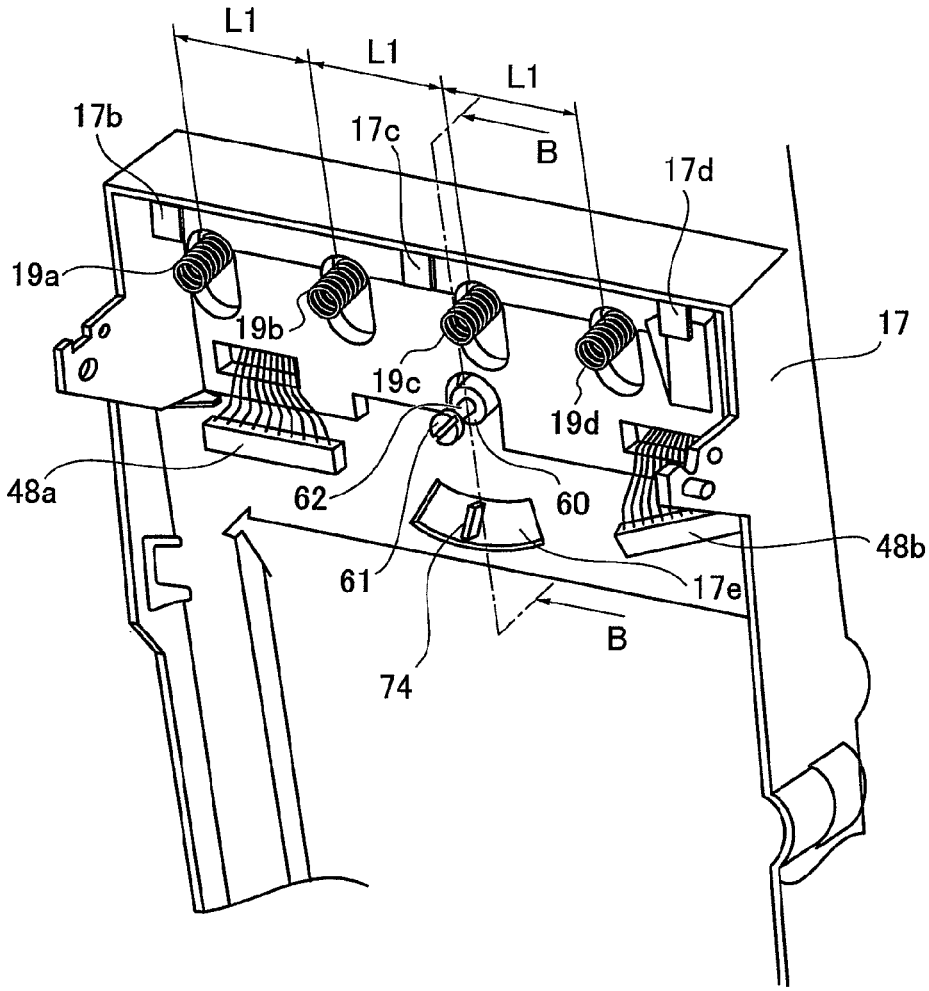
FIG. 7A shows the frame of the cover element with the thermal printhead unit removed additionally.

Specifically, the thermal printhead unit 40 is configured to be manually detachable from the cover frame 17 without any tool by releasing the supported portion 44 from the claws 17*b*, 17*c*, 17*d* and releasing the notch portion 45 from the step portion 61 of the stepped pin 60, as shown in FIG. 7A. Further, the thermal printhead unit 40 includes two terminals 47*a*, 47*b* (FIG. 7B) at both ends connected with the electric connectors 48*a*, 48*b* (FIG. 7A) supplying electric signals or else, respectively. The terminals 47*a*, 47*b* and the electric connectors 48*a*, 48*b* can be also manually disconnected.

Figure 7B:
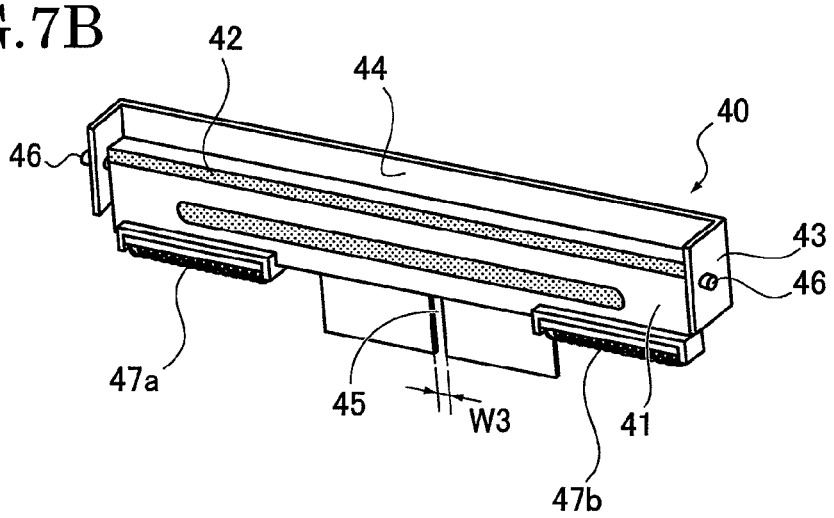
FIG. 7B shows a removed thermal printhead unit.

As shown in FIG. 7B in detail, the thermal printhead unit 40 is comprised of the thermal printhead 41, a head frame 43 attached to the thermal printhead 41, and the supported portion 44 and the notch portion 45 are both formed on the head frame 43.

A width W3 of the notch portion 45 of the head frame 43 is slightly larger than the diameter of a pin portion 62 of the stepped pin 60 and smaller than the diameter of the step portion 61 of the stepped pin 60. Therefore, the pin portion 62 passes through the notch portion 45 but the step portion 61 cannot so that the periphery of the notch portion 45 is hooked on the step portion 61.

Moreover, the supported portion 44 is also hooked on the claws 17*b*, 17*c*, 17*d*, and four springs 19*a*, 19*b*, 19*c*, 19*d* are disposed between the head frame 43 and the cover frame 17 to generate a bias force to press the supported portion 44 onto the claws 17*b*, 17*c*, 17*d* and press the periphery of the notch portion 45 to the step portion 61.

The four springs 19*a*, 19*b*, 19*c*, 19*d* are disposed on the back of the exothermic element array 42 with the thermal printhead unit 40 attached to the cover frame 17. Because of this, the exothermic element array 42 is properly brought into close contact with a later-described platen roller 21.

In addition, the four springs 19*a*, 19*b*, 19*c*, 19*d* are arranged with an equal interval L1 in the width direction of the thermal paper 200. The interval L1 is set so that the exothermic element array can evenly contact with the thermal paper 200 in the width direction irrespective of the width of the thermal paper 200.

That is, with use of the thermal paper 200 in the wide width W1, the bias force of the equally disposed springs 19*a*, 19*b*, 19*c*, 19*d* causes the exothermic element array 42 to be evenly in close contact with the thermal paper 200 in the width direction. Meanwhile, with use of the thermal paper 200 in the narrow width W2, the rightmost spring 19*d* is removed and the bias force of the three springs 19*a*, 19*b*, 19*c* causes the exothermic element array 42 to be evenly in close contact with the thermal paper 200 in the width direction.

Note that to deal with two kinds of paper in the widths W1, W2, the interval L1 can be set to such a value as to be about a highest common factor of the widths W1, W2. For example, the interval L1 is set to 1 inch (about 20 mm) when papers in the wide width W1 of 3 inches (about 80 mm) and the narrow width W2 of 2 inches (about 60 mm) are used. The positions of the four springs 19*a* to 19*d* or the three springs 19*a* to 19*c* are adjusted so that they are almost equally separated from each other from both edges of the thermal paper 200.

Two protrusions 46 as a positioning element are formed on both sides of the head frame 43 along the extension line of the exothermic element array, to engage with the platen roller unit 20.

Next, a structure to attach/detach the thermal printhead unit 40 to/from the cover frame 17 will be described with reference to FIGS. 8A to 8D.

Figure 8A:
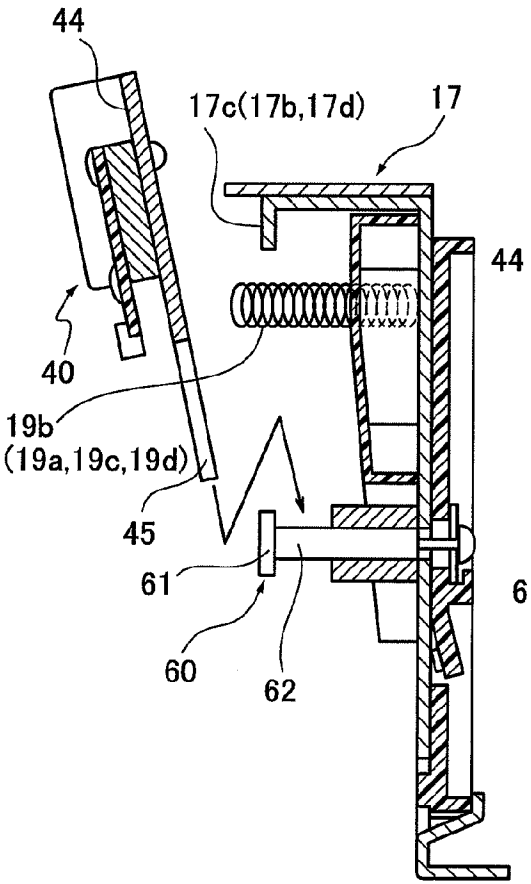
FIGS. 8A to 8D are cross sectional views of the cover frame along the B to B line in FIG. 7A, showing a process in which the thermal printhead unit is attached to the cover frame.
Figure 8B:
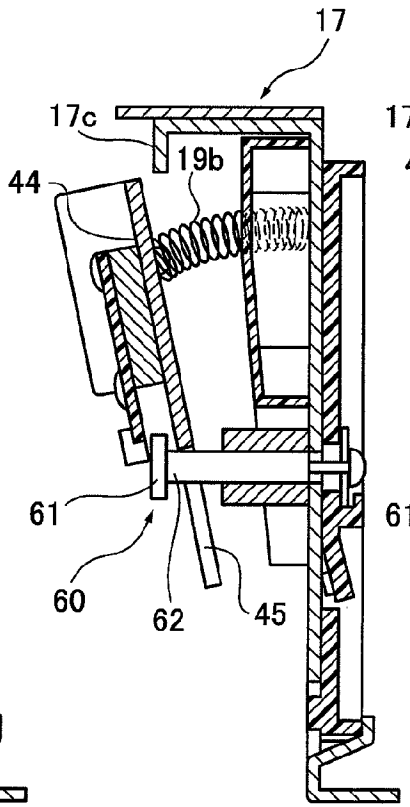
Figure 8C:
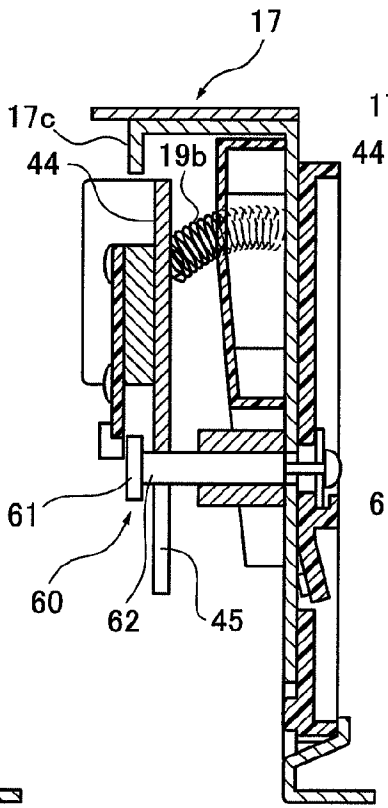
Figure 8D:
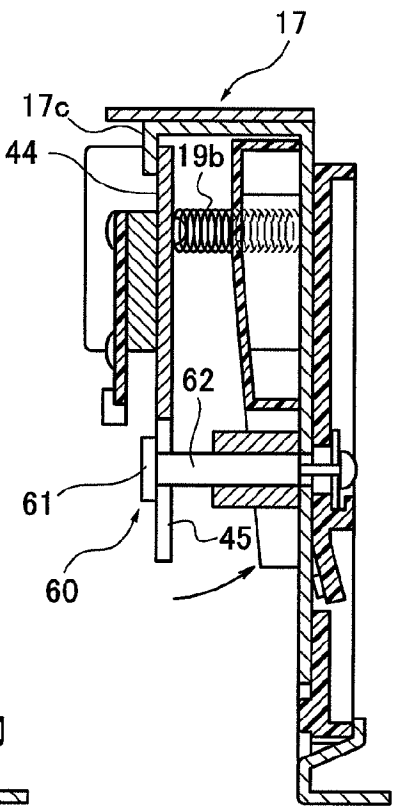

To attach the thermal printhead unit 40 to the cover frame 17 (FIG. 7B), first, the notch portion 45 is inserted into the pin portion 62 of the stepped pin 60 so that the periphery of the notch portion 45 is hooked on the step portion 61 as shown in FIGS. 8A, 8B. Then, while the springs 19*a*, 19*b*, 19*c*, 19*d* contacting with the back face of the head frame 43 (or exothermic element array 42) are contracted, the supported portion 44 is moved to the back side of the claws 17*b*, 17*c*, 17*d* as shown in FIGS. 8B, 8C. Thereafter, the entire thermal printhead unit 40 is moved to the base side of the claws 17*b*, 17*c*, 17*d*, thereby fitting the supported portion 44 into the claws 17*b*, 17*c*, 17*d* as shown in FIG. 8D.

Thus, the thermal printhead unit 40 is attached to the cover frame 17 by the engagement of the supported portion 44 and the claws 17*b*, 17*c*, 17*d* and the engagement of the notch portion 45 and the step portion 61 of the stepped pin 60.

For detaching the thermal printhead unit 40 from the cover frame 17, the above process should be reversed.

As described above, in the thermal printer 100 according to the present embodiment the thermal printhead unit 40 is manually detachable from the cover frame 17 without any tool.

When attached to the cover frame 17, the thermal printhead unit 40 is biased leftward (a direction to approach the platen roller 21 when the cover element 12 is in the closed position) in FIGS. 8A to 8D by the springs 19*a*, 19*b*, 19*c*, 19*d*. However, the thermal printhead unit 40 can be inclined vertically in a traveling direction of the thermal paper 200 when the thermal printer 100 is in normal use with the cover element 12 closed since the front and back ends (portions upper and lower than the exothermic element array 42) thereof are movable rightward (a direction to be separated from the platen roller 21 when the cover element 12 is in the closed position).

Further, the notch portion 45 from the back edge to the front of the head frame 43 is configured to have a length longer than an engaging portion of the claws 17*b*, 17*c*, 17*d* and the supported portion 44 in a front-back direction (vertically in FIGS. 8A to 8D). Therefore, for attaching the thermal printhead unit 40 to the cover frame 17, first, the notch portion 45 is inserted into the stepped pin 60 and hooked on the step portion 61 thereof. Then, with the insertion maintained, the thermal printhead unit 40 is moved backward (downward in the drawings) so that the stepped pin 60 is positioned at the base of the notch portion 45. Thereafter, the front end (top end in the drawings) of the thermal printhead unit 40 is moved to the back side (right side) of the claws 17*b*, 17*c*, 17*d* of the cover frame 17, to move the thermal printhead unit 40 forward (upward) by the engaging portion of the claws 17*b*, 17*c*, 17*d* and the supported portion 44. Thereby, the front end of the thermal printhead unit 40 is hooked on the claws 17*b*, 17*c*, 17*d* and the back part thereof is hooked on the stepped pin 60. Thus, the thermal printhead unit 40 can be easily attached to the cover frame 17 manually without any tool.

Similarly, the thermal printhead unit 40 can be easily detached from the cover frame 17 manually without any tool by performing the above process reversely.

Figure 9A:
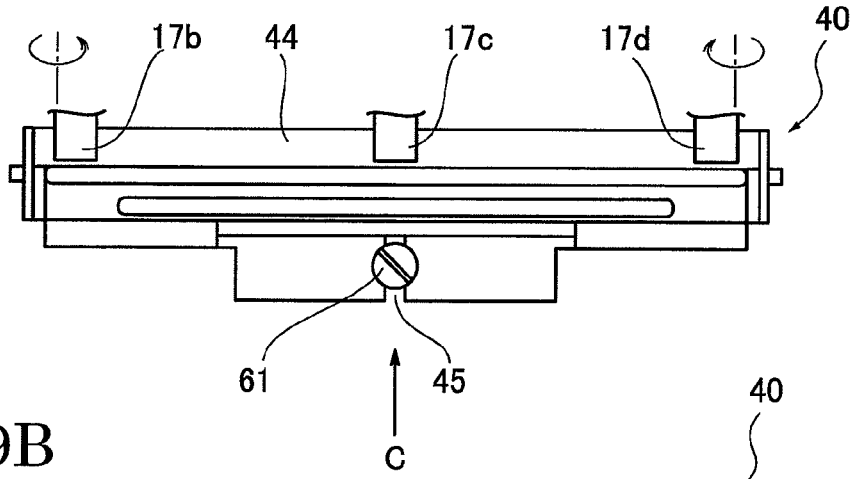
FIGS. 9A to 9D show the thermal printhead unit attached to the cover frame vertically inclining in a width direction.
Figure 9B:
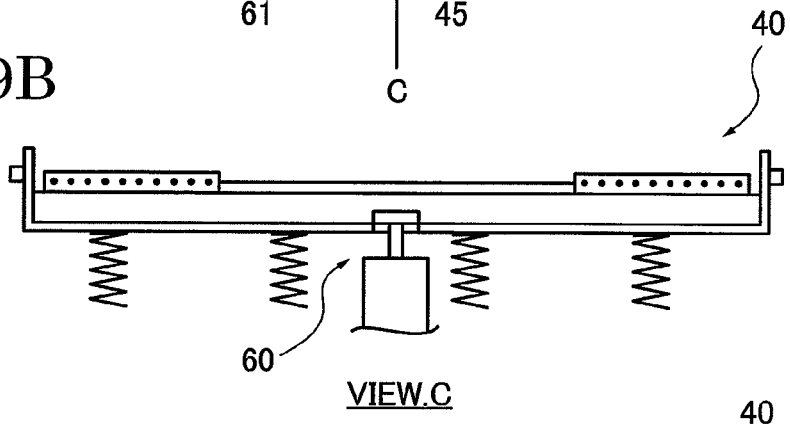
Figure 9C:
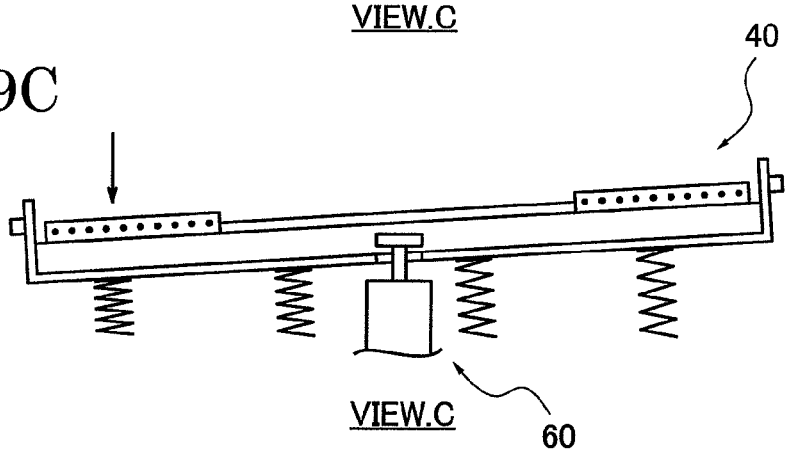
Figure 9D:
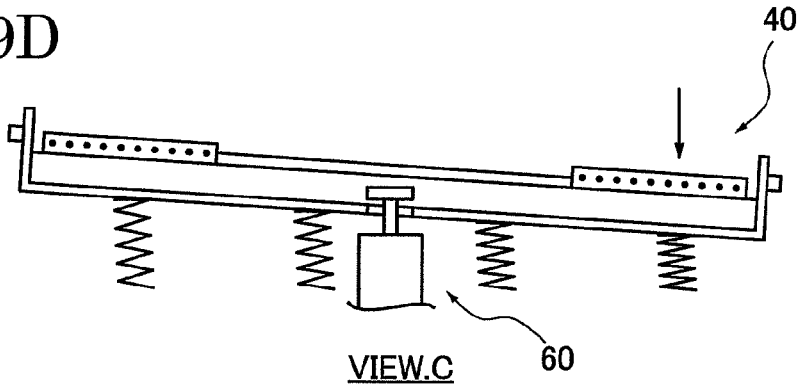

Furthermore, as shown in FIGS. 9A, 9B, the back portion of the thermal printhead unit 40 is supported by only one position (notch portion 45) at about the center of the width direction. Because of this, the thermal printhead unit 40 has the degree of freedom of vertically inclining around the supported portion (about the center of the portion hooked on the step portion) in the width direction as shown in FIGS. 9C, 9D.

An uneven abrasion such as a conic abrasion may occur in a contact portion of the platen roller 21 with the exothermic element array 42 of the thermal printhead unit 40 in the width direction. However, the thermal printhead unit 40 is configured to be inclined in the width direction so that it can negate a difference in the surface of the platen roller 21 due to the uneven abrasion. Thereby, the exothermic element array 42 can be made in contact with the platen roller 21 evenly.

Figure 10:
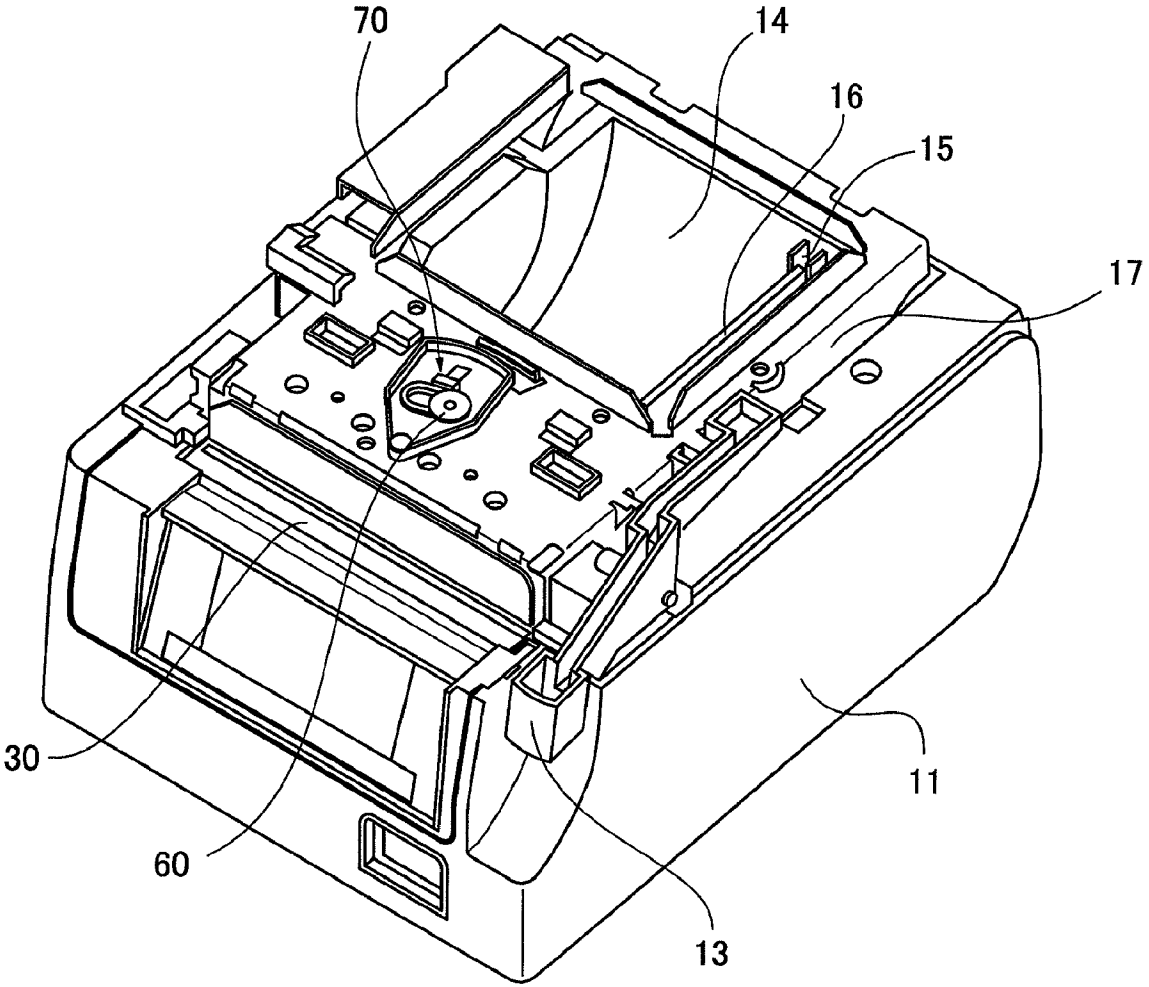
FIG. 10 is a perspective view of the thermal printer in FIG. 1 with an outer package (resin made) of the cover element removed.

FIG. 10 shows the thermal printer with an outer package of the cover element 12 removed therefrom when the cover element 12 is in the closed position.

The cover frame 17 comprises a stepped pin adjuster element 70 which axially moves the stepped pin 60 fitted into the notch portion 45 of the thermal printhead unit 40 to vertically change the position of the step portion 61.

Figure 11A:
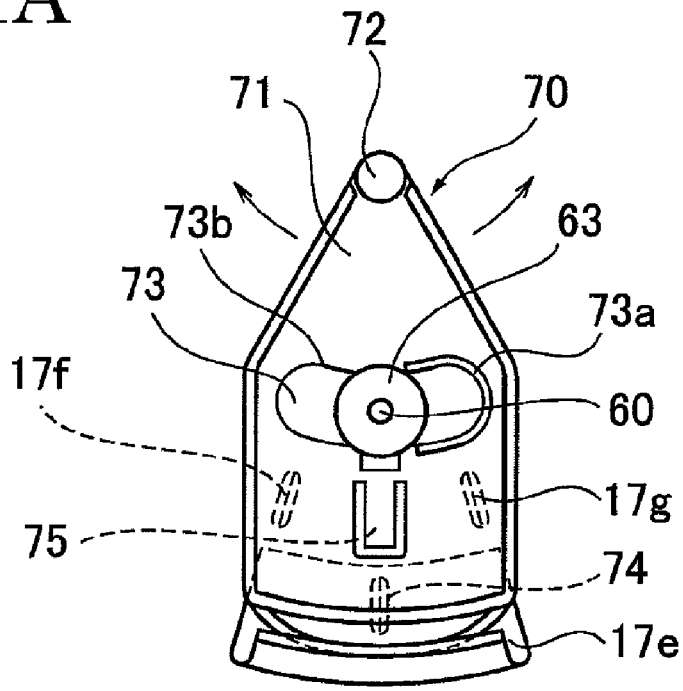
FIG. 11A shows a stepped pin adjuster element seen from the outside of the cover frame in FIG. 10
Figure 11B:
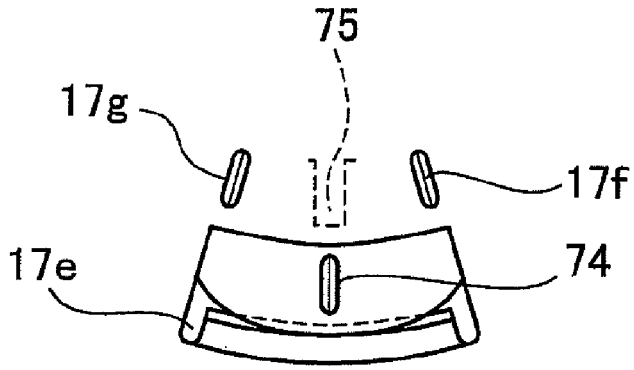
FIG. 11B shows the same with the cover element in an open position seen from the inside of the cover frame.

The stepped pin adjuster element 70, as shown in FIG. 11A, 11B, is configured of a substantially pentagon-shaped movable plate 71 and supported by a pin 72 to be rotatable therearound. The movable plate 71 includes a long opening 73 extending in the rotary direction through which the stepped pin 60 is inserted. It is movable in the extending direction of the long opening 73 with the stepped pin 60 inserted.

The long opening 73 comprises a rim 73*a* in an uneven thickness. One portion of the rim 73*a* from the center to one movable area (right side in FIG. 11A) is larger in thickness than the movable plate 71. The other portion thereof in the other half of the movable area (left side in FIG. 11A) including the center is equal in thickness to the movable plate 71. The long opening 73 can function as a cam owing to a difference in thickness of the rim.

For convenience, the other portion of the rim 73*a* whose thickness is equal to that of the movable plate 71 is referred to as a thin rim 73*b*.

Further, a tongue-like piece with a protrusion 75 on a back face (facing the cover frame 17) is provided in the vicinity of the long opening 73 of the movable plate 71. The protrusion 75 is configured to fit into concavities 17*f*, 17*g* of the cover frame 17 on both ends of the movable (rotatable) area when the movable plate 71 is moved in the movable area with the stepped pin 60 inserted through the long opening 73. This allows an operator to feel the movable plate 71's hitting the both ends as well as prevents the movable plate 71 with the protrusion fitted into either of the concavity 17*f*, 17*g* from unnecessarily moving.

Moreover, as in FIG. 11B showing the back side of FIGS. 7, 11A, the movable plate 71 includes a window 17*e* in a portion corresponding to the outer circumference of the cover frame 17. The window 17*e* extends along the movable area of the movable plate 71 to allow the back face of the outer circumference of the movable plate 71 to expose. On the exposed portion of the movable plate 71 provided is a protrusion 74 to allow an operator to place a finger thereon to rotate the exposed movable plate 71 around the pin 72.

The stepped pin 60 comprises, at a top end, a flat washer 63 as a large diameter portion whose diameter is larger than that of the stepped pin 60. When protruding from the long opening 73, the flat washer 63 is hooked on the rims 73*a*, 73*b* as a cam. When hooked on the thick rim 73*a* by the rotation of the movable plate 71, the flat washer 63 is pulled up to the front side of FIG. 12A by a difference in thicknesses of the rims, 73*a*, 73*b*. This also moves the stepped pin 60 joined with the flat washer 63 to the front side of the drawing, that is, in the axial direction of the stepped pin 60. Meanwhile, when hooked on the thin rim 73*b*, the flat washer 63 does not move.

Figure 12A:
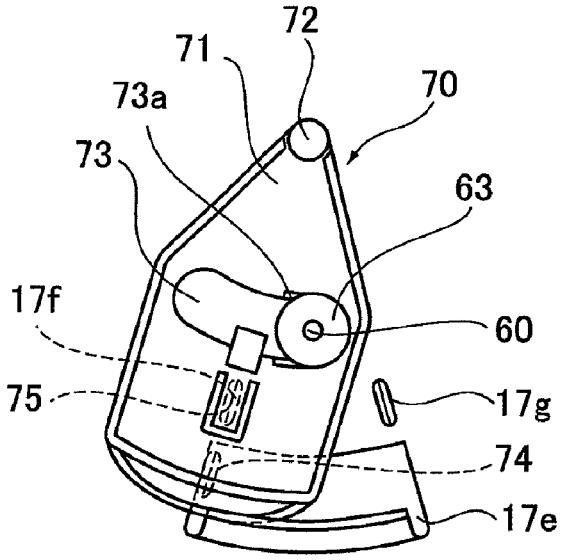
FIGS. 12A to 12C show an inclined thermal printhead in accordance with a position of the stepped pin adjuster element for a thick thermal paper in FIGS. 11A, 11B, FIG. 8, respectively.
Figure 12B:
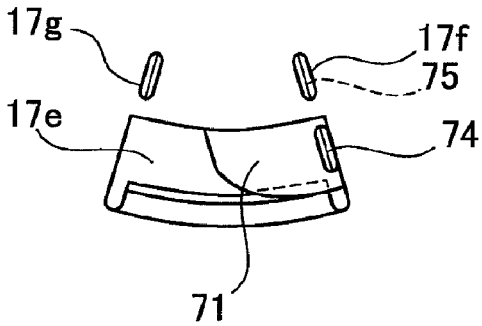

This movement is described with reference to FIGS. 12A to 12C, 13A to 13C. First, as shown in FIG. 12B, an operator places a finger on the protrusion 74 exposed from the window 17*e* to inside of the cover frame 17 to move the protrusion 74 to the right end of the drawing. As shown in FIG. 12A, the movable plate 71 is rotated around the pin 72 to the left side and the flat washer 63 of the stepped pin 60 inserting through the long opening 73 is hooked on the thick rim 73*a* of the long opening 73.

At the same time, the protrusion 75 is fitted into the concavity 17*f* of the cover frame 17. Thereby, the operator can feel the completion of the rotary operation of the movable plate 71. Also, the movable plate 71 can be prevented from unnecessarily moving.

Figure 12C:
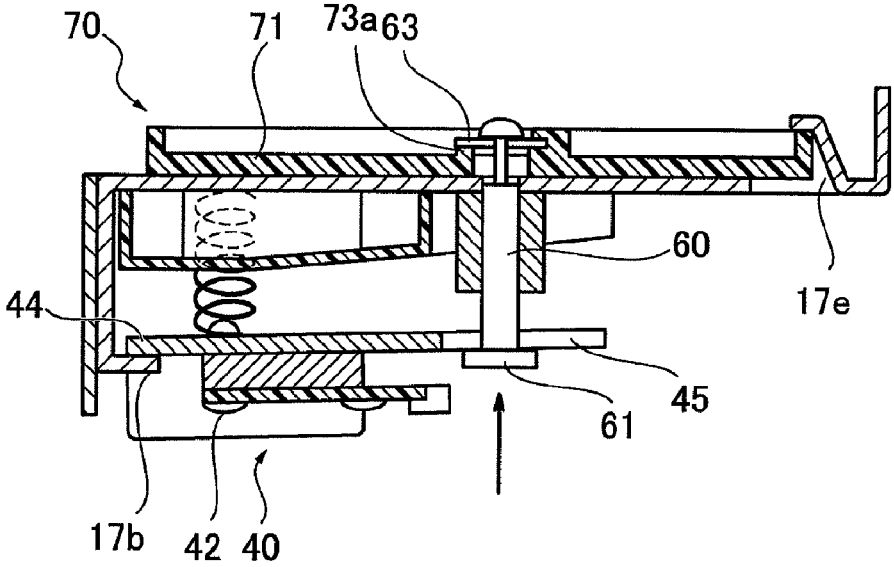

The flat washer 63 is moved up by a difference in thickness between the rims 73*a*, 73*b* in FIG. 12C (cover element 12 in the closed position), which moves up the stepped pin 60 joined with the flat washer 63 (in FIG. 12C).

The step portion 61 at the bottom end of the stepped pin 60 is also moved up. Accordingly, the notch portion 45 of the thermal printhead unit 40 is moved up, and the posture of the thermal printhead unit 40 is inclined counterclockwise by an amount of the upward movement of the notch portion 45.

Figure 13A:
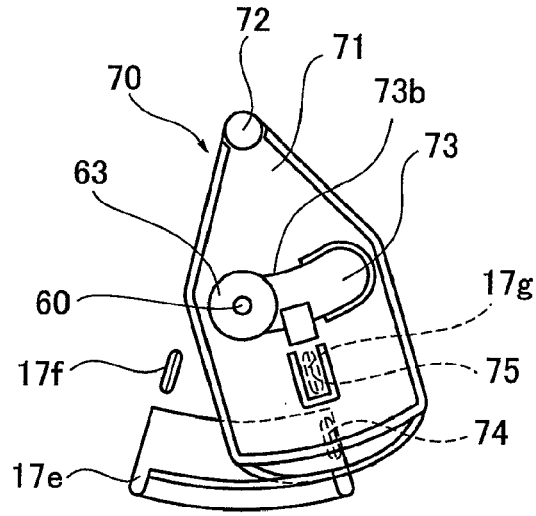
FIGS. 13A to 13C show an inclined thermal printhead in accordance with a position of the stepped pin adjuster element for a thin thermal paper in FIGS. 11A, 11B, FIG. 8, respectively.
Figure 13B:
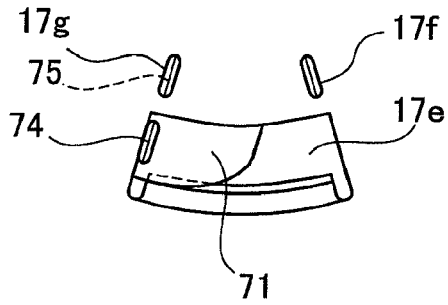

Meanwhile, as shown in FIG. 13B, the operator places a finger on the protrusion 74 exposed from the window 17*e* to inside of the cover frame 17 to move the protrusion 74 to the left end of the drawing. As shown in FIG. 13A, the movable plate 71 is rotated around the pin 72 to the right side and the flat washer 63 of the stepped pin 60 inserting through the long opening 73 is hooked on the thin rim 73*b* of the long opening 73.

At the same time, the protrusion 75 is fitted into the concavity 17*g* of the cover frame 17. Thereby, the operator can feel the completion of the rotary operation of the movable plate 71. Also, the movable plate 71 can be prevented from unnecessarily moving.

Figure 13C:
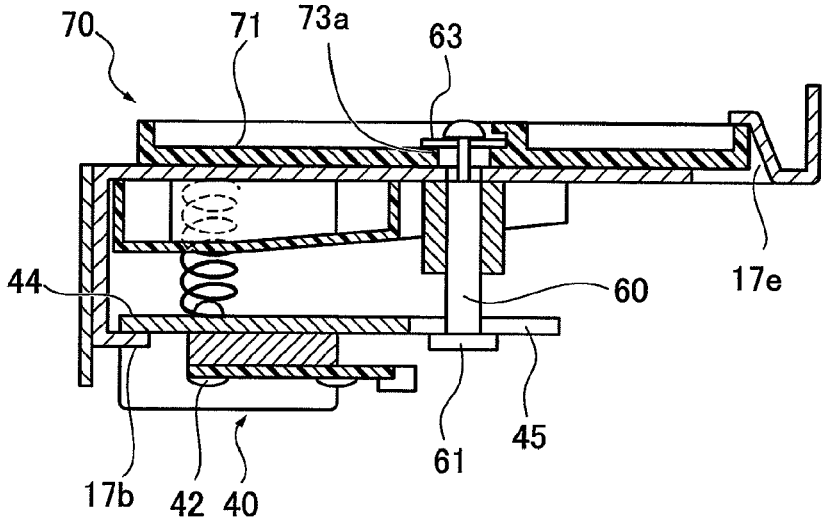

The flat washer 63 is moved down by a difference in thickness of the rims 73*a*, 73*b* in FIG. 13C (cover element 12 in the closed position), which moves down the stepped pin 60 joined with the flat washer 63.

The step portion 61 at the bottom end of the stepped pin 60 (in FIG. 13C) is also moved down. Accordingly, the notch portion 45 of the thermal printhead unit 40 is moved down, and the posture of the thermal printhead unit 40 is inclined clockwise by an amount of the downward movement of the notch portion 45.

Inclination of the thermal printhead unit 40 will be further described in detail after the platen roller unit 20 is described.

Figure 14:
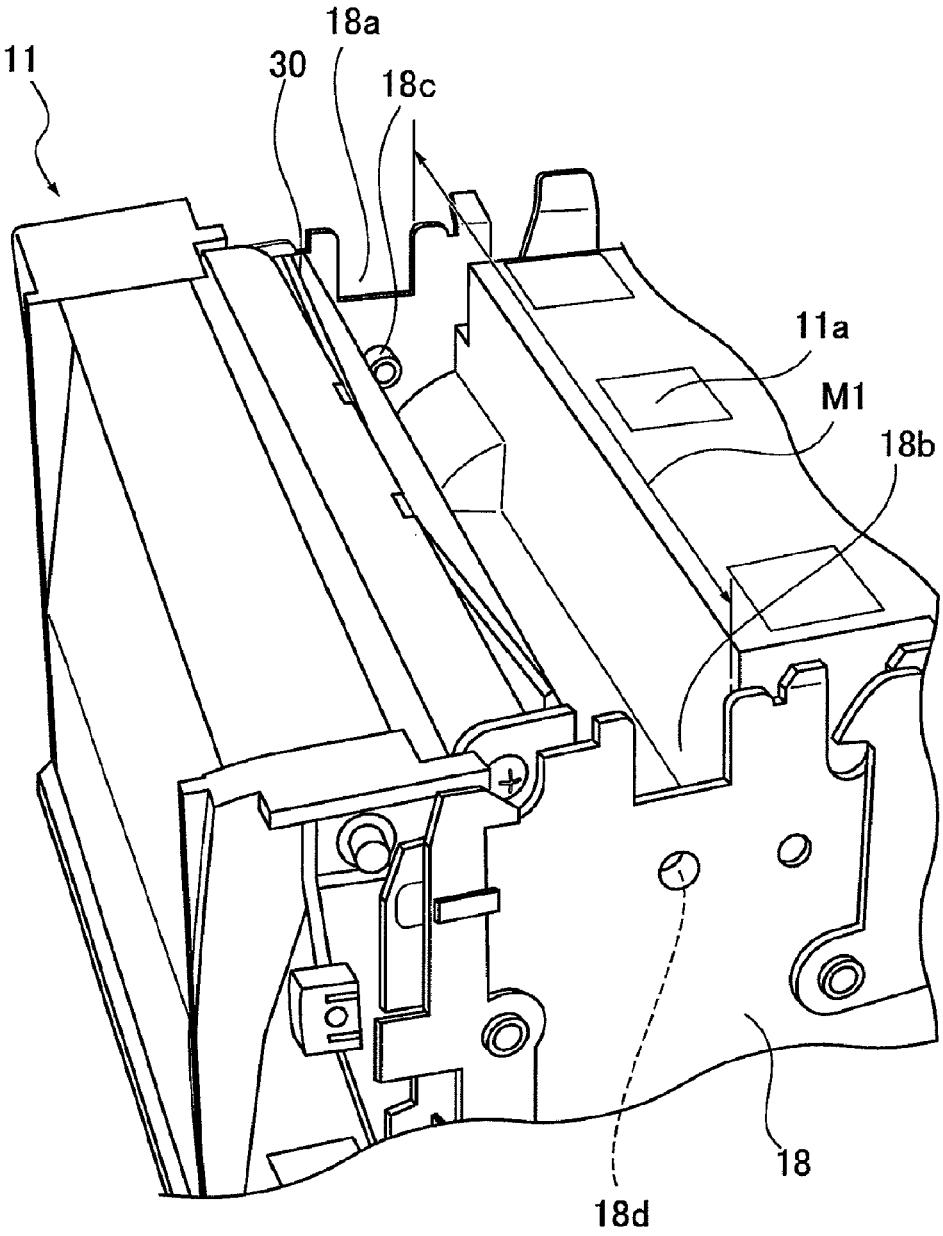
FIG. 14 is a perspective view of a body frame on which the platen roller unit is mounted.

The platen roller unit 20 is attached to a frame 18 of the body 11 in FIG. 14 and disposed in the body 11 in FIG. 3.

Figure 15:
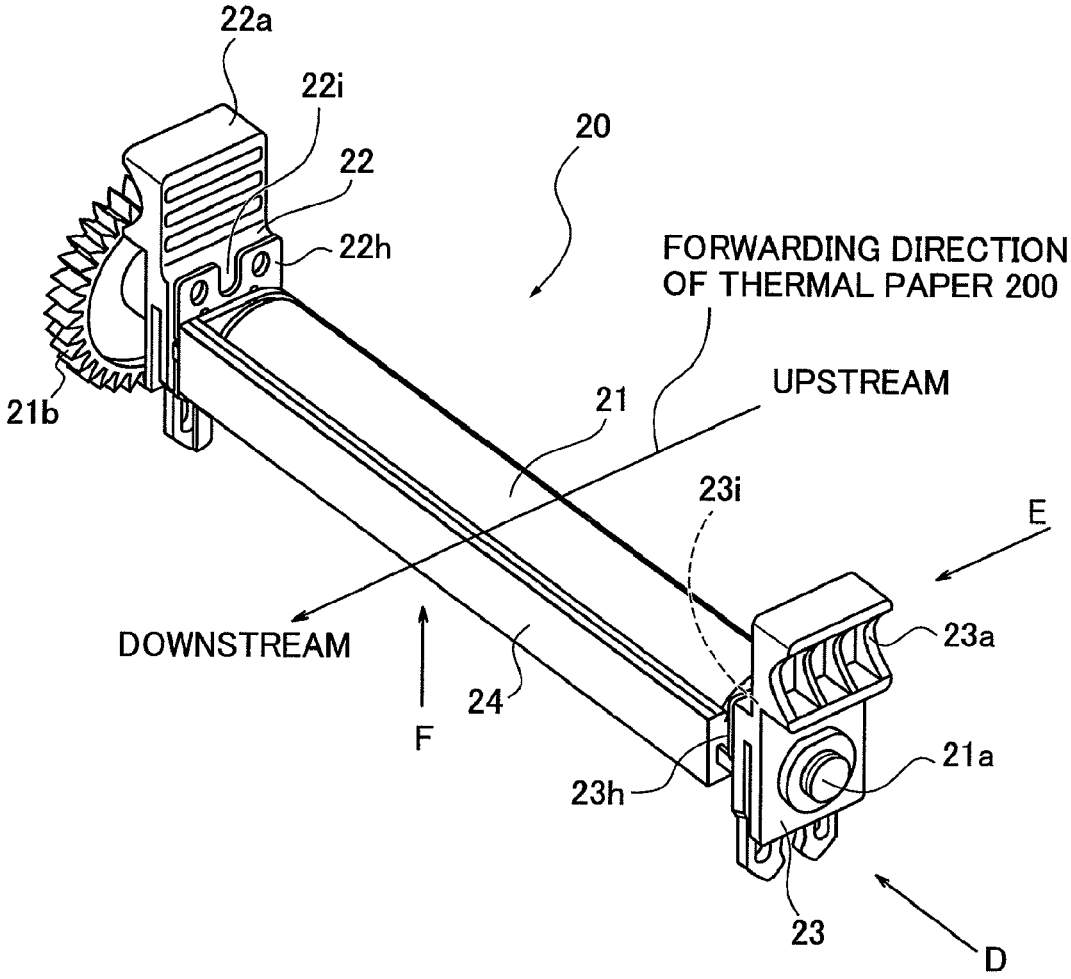
FIG. 15 is a perspective view of the platen roller unit detached from the body frame.

Detached from the body frame 18, the platen roller unit 20 in FIG. 15 comprises a platen roller 21, a rotary shaft 21*a* protruding from both ends of the platen roller 21, support elements 22, 23 rotatably supporting the rotary shaft 21*a*, and a paper separating frame 24 attached to the protruding ends of the rotary shaft 21*a* and the support elements 22, 23 and extending in parallel to the rotary shaft on both (upstream and downstream) sides of the platen roller 21 in the forwarding direction of the thermal paper 200.

When the thermal paper is forwarded between the platen roller 21 and the thermal printhead 41 from the upstream, the paper separating frame 24 functions as a guide to properly pull off the thermal paper 200 from the platen roller 21 and forward it to the downstream as well as to prevent the thermal paper 200 wound around the platen roller 21 from traveling in an unintended direction.

The support elements 22, 23 are the same structure and made of resin elements 22*a*, 23*a* and metal plates 22*h*, 23*h*, respectively.

Figure 16A:
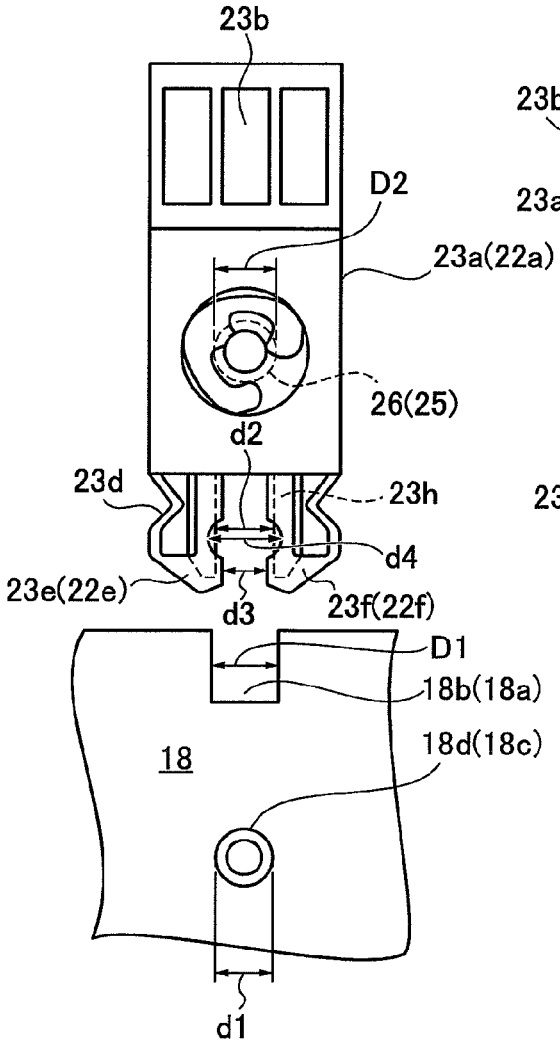
FIGS. 16A, 16B show a support element for the platen roller unit in detail, seen from the arrows D, E in FIG. 15, respectively.
Figure 16B:
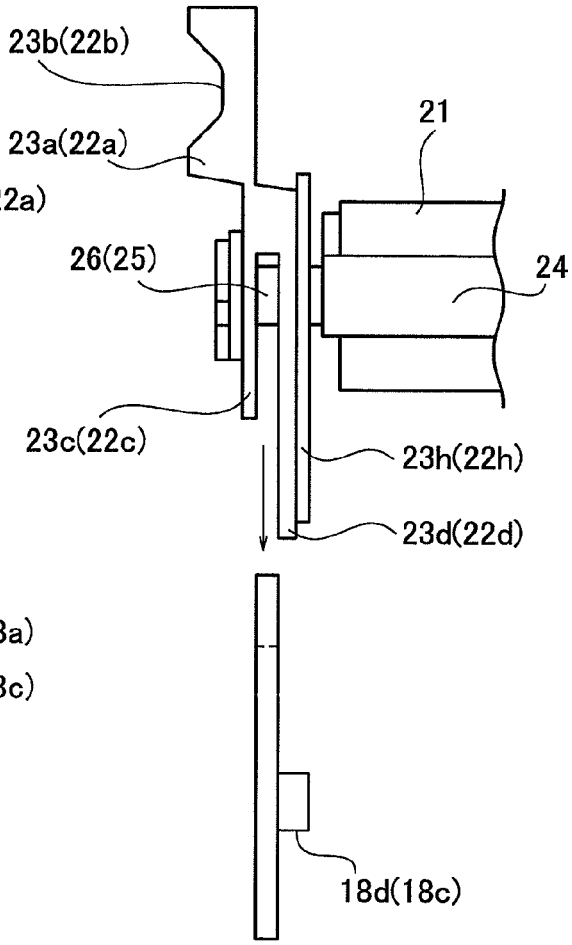

As shown in FIGS. 16A, 16B, the resin elements 22*a*, 23*a* include finger hooks 22*b*, 23*b* on portions higher than the platen roller 21, respectively. The finger hooks 22*b*, 23*b* are configured for an operator to place a finger thereon and pull up the entire platen roller unit attached to the body frame 18 (FIG. 3) (in the same direction as the moving direction of the cover element 12 from the closed position) for detaching the platen roller unit 20 from the body 11.

Also, the resin elements follow the finger hooks 22*b*, 23*b* and are split into two in the width direction of the platen roller 21 to form two leg portions 22*c* (23*c*), 22*d* (23*d*) as shown in FIG. 16B.

The inside leg portions 23*d* (22*d*) are formed to be longer than the outside leg portions 23*c*, (22*c*) and are further split into two to form two legs 23*e* (22*e*), 23*f* (22*f*) as shown in FIGS. 16A, 16B.

The rotary shaft 21*a* of the platen roller 21 protrudes from both ends of the platen roller 21 and the protruding portions penetrate through the outside and inside leg portions 23*c* (22*c*), 23*d* (22*d*). A bearings 26 (25) is provided around a portion of the rotary shaft 21*a* passing through a space between the leg portions 23*c* (22*c*), 23*d* (22*d*) to rotatably support the rotary shaft 21.

Figure 17A:
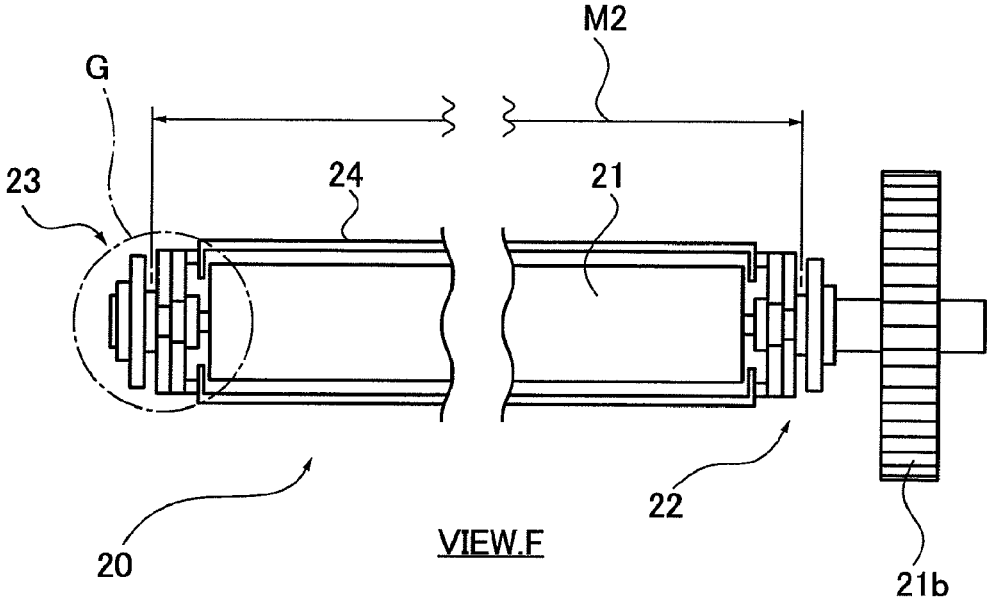
FIG. 17A shows the support element for the platen roller unit in detail, seen from the arrow F in FIG. 15.
Figure 17B:
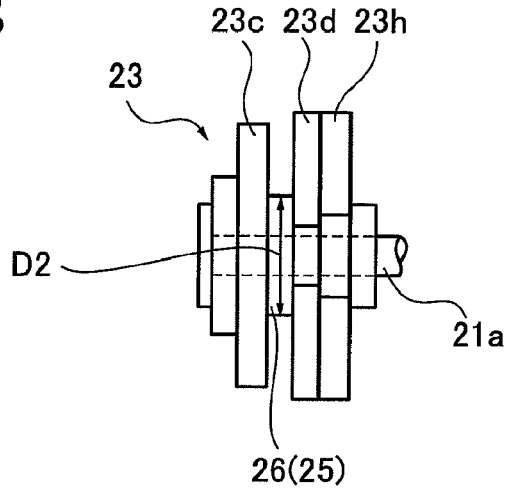
FIG. 17B shows a portion G in FIG. 17A in detail.

Further, the body frame 18 includes a notch 18*b* (18*a*) (to engage with the platen roller) in a width D1 on both sidewalls in the width direction in FIGS. 14, 16A. The width D1 is equal to or slightly larger than the outer diameter D2 of the bearing 26 (25) as shown in FIG. 17B (D2≦D1).

The width between the two leg portions 23*c* (22*c*), 23*d* (22*d*) is set to be slightly larger than the thickness of the body frame 18. A length M2 (in FIG. 17A) from the space between the leg portions 23*c*, 23*d* to that between the other leg portions 22*c*, 22*d* is set to be almost equal to a distance M1 from both sidewalls of the body frame 18 in the width direction (FIG. 14). The platen roller unit 20 is thus attached to the body frame 18 with one sidewall inserted into the space between one leg portions 23*c*, 23*d* and the other sidewall inserted into the space between the other leg portions 22*c*, 22*d*.

Moreover, the bearing 26 for the rotary shaft 21*a* passing through the space between the leg portions 23*c*, 23*d* is engaged with the notch 18*b* of the one sidewall of the body frame 18 while the bearing 25 thereof passing through the space between the leg portions 22*c*, 22*d* is engaged with the notch 18*a* of the other sidewall of the body frame 18. Thereby, the platen roller unit 20 is positioned vertically or longitudinally relative to the body frame 18.

The two legs 23*e* (22*e*), 23*f* (22*f*) of the legs portion 23*d* (22*d*) are disposed with gaps d3, d4. The gap d3 between the bottom ends of the legs is narrower than the gap d4 (d3<d4) between the portions above the bottom ends as shown in FIG. 16A.

Further, the metal plates 22*h*, 23*h* of the support elements 22, 23 as shown in FIG. 16B are in close contact with the inner faces of the inside legs 22*d*, 23*d* in the width direction. The metal plates 22*h*, 23*h* are also split into two from portions below the portions through which the rotary shaft 21*a* penetrates. A gap d2 between the two split portions is larger than the gap d3 but smaller than the gap d4 (d3<d2<d4).

Note that the center of the gap d2 between the two split portions and the centers of the gaps d3, d4 between the legs 23*e* (22*e*), 23*f* (22*f*) coincide with one another, and the center of the rotary shaft 21*a* (or bearing 26 (25)) is positioned on the upward extension line of the centers.

Meanwhile, bosses 18*c*, 18*d* in diameter d1 are formed on both of the sidewalls of the body frame 18, to protrude from the sidewalls internally in the width direction. The bosses 18*c*, 18*d* are provided with a distance from the bottom ends of the notches 18*a*, 18*b* corresponding to a distance from the bottom faces of the bearings 25, 26 in which the gap between the legs 23*e* (22*e*), 23*f* (22*f*) becomes d4.

The diameter d1 of the bosses 18*c*, 18*d* is set to be equal to or slightly smaller than the gap d2 of the two split portions of the metal plates 22*h*, 23*h* of the support elements 22, 23. The bosses 18*c*, 18*d* are formed so that the centers of the notches 18*a*, 18*b* are positioned on the vertical line of the centers of the bosses 18*c*, 18*d*, respectively.

Figure 18A:
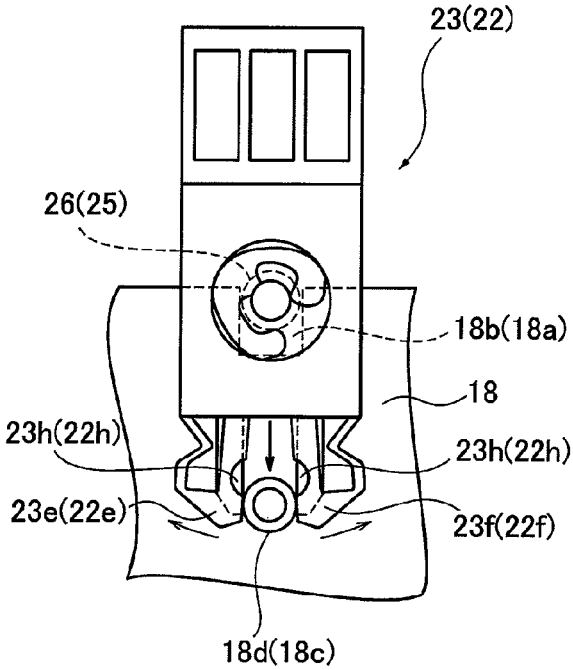
FIGS. 18A, 18B show one example of how the platen roller unit is attached to the body frame, corresponding to FIGS. 16A, 16B, respectively.
Figure 18B:
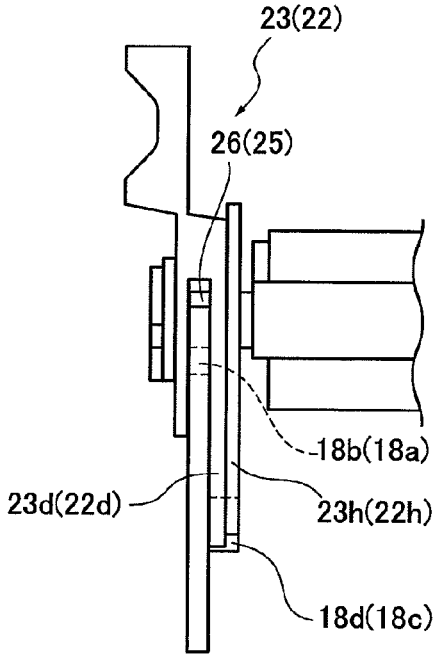

With such a configuration, the platen roller unit 20 is moved down vertically relative to the body frame 18 and attached thereto by engaging the bearing 25 of the platen roller unit 20 with the sidewall notch 18*b* of the body frame 18 as well as the bearing 26 of the platen roller unit 20 with the sidewall notch 18*a* of the body frame 18. Along with the downward movement, the boss 18*d*, (18*c*) is inserted through the gap between the legs 23*e* (22*e*), 23*f* (22*f*) of the support elements 23 (22) as shown in FIGS. 18A, 18B.

The diameter d1 of the boss 18*d* (18*c*) is larger than the gap d2 at the bottom of the legs 23*e* (22*e*), 23*f* (22*f*) of the support elements 23 (22), so that the legs are elastically deformed to expand the gap d2 along with the insertion of the boss 18*d*, (18*c*). According to the present embodiment, the legs are made of resin materials and elastically deformable. However, the present invention is not limited thereto. The legs can be made of thin metal materials.

Meanwhile, the gap d2 between the two split portions of the metal plates 23*h* (22*h*) is equal to or slightly larger than the diameter d1 of the boss 18*d* (18*c*) so that the boss 18*d* (18*c*) is moved along the gap without expanding it.

Figure 19A:
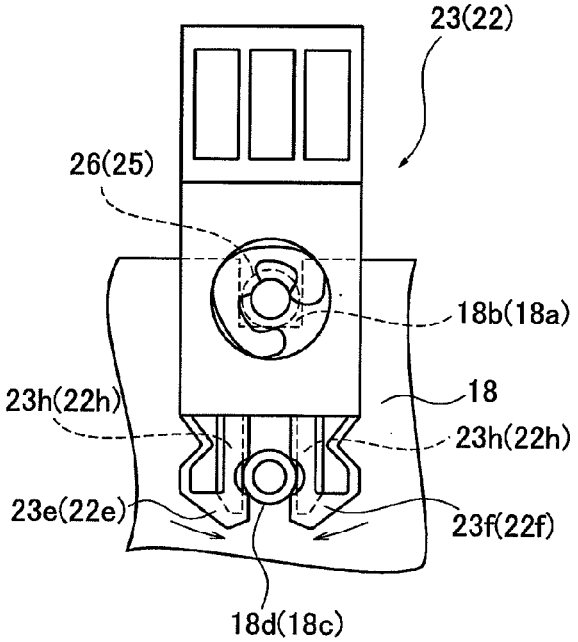
FIG. 19A, 19B show another example of how the platen roller unit is attached to the body frame, corresponding to FIGS. 16A, 16B, respectively.
Figure 19B:
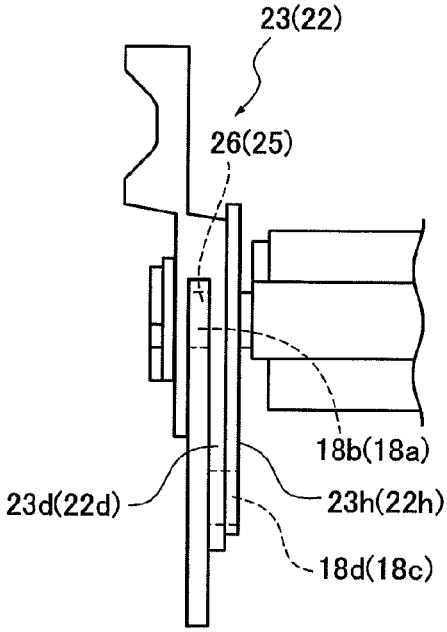

With further downward movement of the platen roller unit 20, as shown in FIGS. 19A, 19B, the bearing 26 of the platen roller unit 20 is fitted into the sidewall notch 18*b* of the body frame 18, and the bearing 25 of the platen roller unit 20 is fitted into the sidewall notch 18*a* of the body frame 18. This stops the downward movement of the platen roller unit 20.

When attached to the body frame 18, a backlash of the platen roller unit 20 relative to the body frame 18 is preventable since the sidewall notches 18*b*, 18*a* of the body frame 18 are configured to be equal to or slightly larger than the bearings 26, 25 of the platen roller unit 20, respectively.

Furthermore, the boss 18*d* (18*c*) advances and reaches the gap d4 between the two legs 23*e* (22*e*), 23*f*, (22*f*) wider than the gap d2 (≈d1) between the two split portions of the metal plates 23*h*, (22*h*).

Because the gap d4 is larger than the diameter of the boss 18*d* (18*c*), the outer elastic deformation of the two legs 23*e* (22*e*), 23*f*, (22*f*) is eliminated. As a result, the lower part of the boss 18*d* (18*c*) is blocked by the gap d2 narrower than its diameter d1. To move up the platen roller unit 20, the narrow gap d2 need be expanded by the boss 18*d* (18*c*) and a load required for expanding the gap acts as a resisting force against the platen roller unit moving upward. Thus, the platen roller unit 20 can be prevented from unintentionally dropping off from the body frame 18.

In addition, it is possible to prevent the support elements 22, 23 from rotating around the bearings 25, 26 while the platen roller unit 20 is attached to the body frame 18 by the engagement of the bearings 25, 26 and the notches 18*a*, 18*b* of the body frame 18.

Needless to say that an operator can move up the platen roller unit 20 against the resisting force using the finger hooks 22*b*, 23*b* to detach the platen roller unit 20 from the body frame 18. The operator can manually attach/detach the platen roller unit 20 without any tools.

Further, both edges of the gap (boss notch) in the metal plate 23*h* (22*h*) are defined by the metal plate 23*h* (22*h*) of high rigidity. Therefore, the gap between the boss notch in the metal plate 23*h* (22*h*) and the outer diameter of the boss 18*d* (18*c*) can be precisely maintained. Also, the two legs 23*e* (22*e*), 23*f*, (22*f*) holding the boss 18*d* (18*c*) therebetween are a part of the elastic resin element 23*a*. This accordingly makes it possible to easily switch holding the boss 18*d* (18*c*) and detaching the boss 18*d* (18*c*) against the elastic force.

Furthermore, the platen roller unit 20 is configured to be able to engage with the body frame 18 and comprises positioning elements to define the position relative to the thermal printhead unit 4 attached to the cover element 12.

That is, in FIG. 15 positioning notches 22*i*, 22*h* as positioning elements are formed in the top parts of the metal plates 22*h*, 23*h* of the support elements 22, 23 of the platen roller unit 20.

These positioning notches 22*i*, 23*i* are fitted into protrusions 46 on both sides of the head frame 43 of the thermal printhead unit 40 in FIGS. 4, 7B with the cover element 12 in the closed position (FIGS. 1, 10), to restrict relative movement of the exothermic element array 42 of the thermal printhead unit 40 and the platen roller 21.

Figure 20:
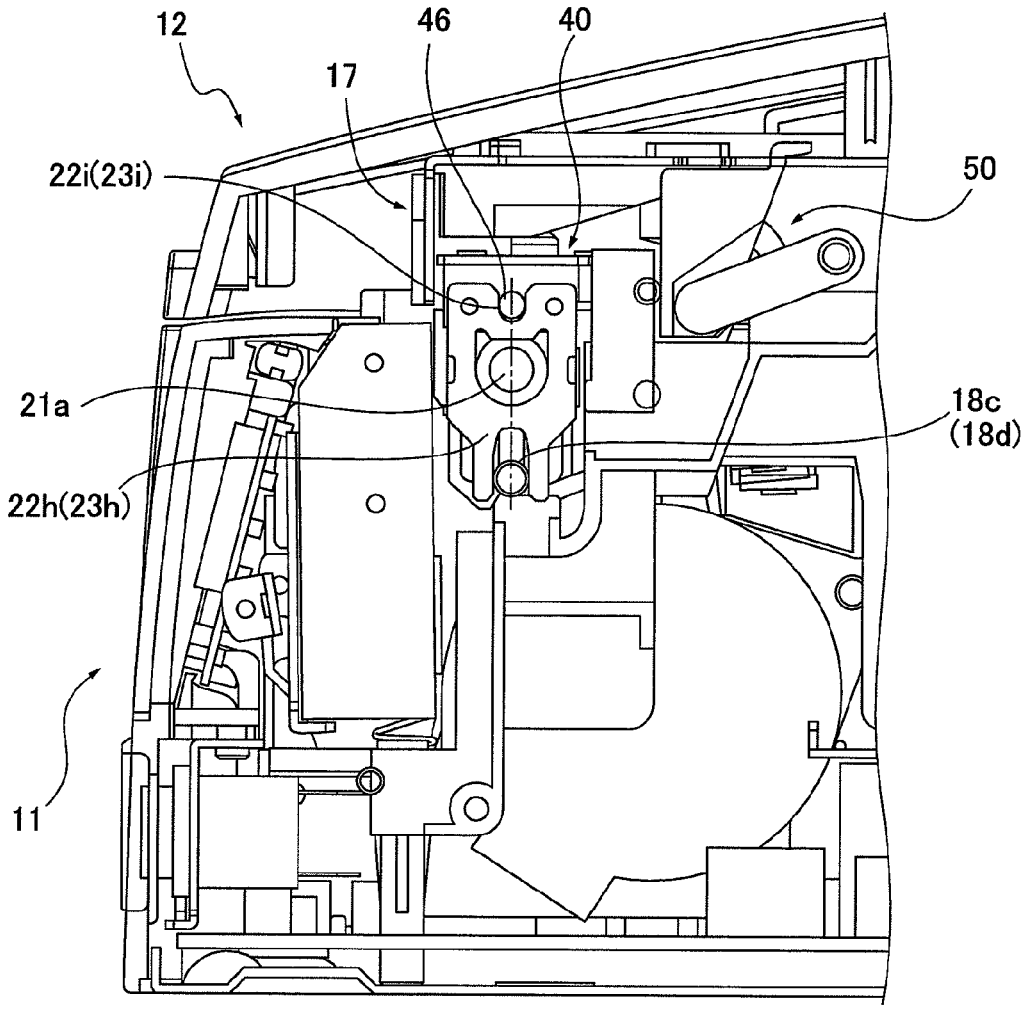
FIG. 20 is a perspective view of the essential elements when a protrusion of the thermal printhead unit engages with a positioning notch of the platen roller unit.

The positioning notches 22*i*, 23*i* are formed in the metal plates 22*h*, 23*h*, respectively so that their centers are positioned on a straight line connecting the center of the rotary shaft 21*a* and the center of the gap of the two split portions of the metal plates 22*h*, 23*h*, as shown in FIG. 20.

Therefore, with the cover element 12 in the closed position, one of the protrusions 46 of the thermal printhead unit 40, the center of the rotary shaft 21*a*, and the boss 18*c* of the body frame 18 are aligned on a single straight line on one sidewall of the body frame 18 (FIG. 20) while the other protrusion 46, the center of the rotary shaft 21*a*, and the boss 18*d* of the body frame 18 are aligned on a single straight line on the other sidewall of the body frame 18.

The platen roller unit 20 is detached from the body 11 by pulling it up in the same direction (upward in the drawings) as the moving direction of the cover element 12 from the closed position. With the cover element 12 closed, the platen roller unit 20 can be firmly fixed to the body 11 and prevented from erroneously detached since the protrusions 46 of the thermal printhead unit 40 attached to the cover element 12 are engaged with the positioning notches 22*i*, 23*i* of the platen roller unit 20.

Further, as shown in FIGS. 12A to 12C, 13A to 13C, the inclination (to the forwarding direction of the thermal paper 200) of the thermal printhead unit 40 is adjustable by manipulating the movable plate 71 of the stepped pin adjuster element 70 to change the position of the step portion 61 of the stepped pin 60.

However, in the above description referring to FIGS. 12A to 12C, 13A to 13C, the thermal printhead unit 40 is inclined while the movement thereof is restricted by the cover frame 17 via the claws 17*b*, 17*c*, 17*d*, stepped pin 60, and springs 19*a* to 19*d*. With the cover element 12 in the closed position, the protrusions 46 of the thermal printhead unit 40 are engaged with the positioning notches 22*i*, 23*i*, and the exothermic element array 42 of the thermal printhead unit 40 and the platen roller 21 contact with each other, so that the exothermic element array 42 moves up against a bias force of the springs 19*a* to 19*d* to contract the springs 19*a* to 19*d*.

Here, the thermal printhead unit 40 moves around the notch portion 45 hooked on the step portion 61, but the movement thereof is restricted to the rotation around the protrusions 46 and upward movement along the positioning notches 22*i*, 23*i* of the platen roller unit 20 by the engagement of the protrusions 46 and the positioning notches 22*i*, 23*i*.

Therefore, the inclination (posture) of the entire thermal printhead unit 40 is defined by the rotation around the protrusions 46 while the vertical position (around the notch portion 45) of the back part thereof is defined by the position of the step portion 61 adjusted by the stepped pin adjuster element 70.

Figure 21A:
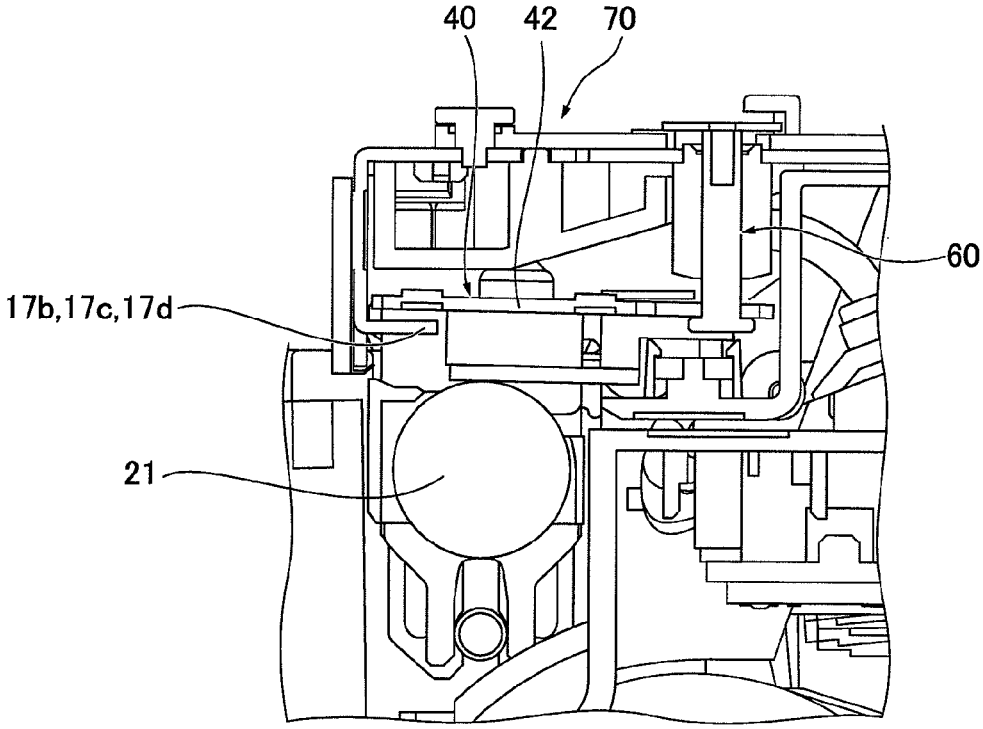
FIG. 21A shows the thermal printhead unit inclined along with a thick thermal paper and FIG. 21B shows the same inclined along with a thin thermal paper when the thermal printhead unit and the platen roller unit are positioned.
Figure 21B:
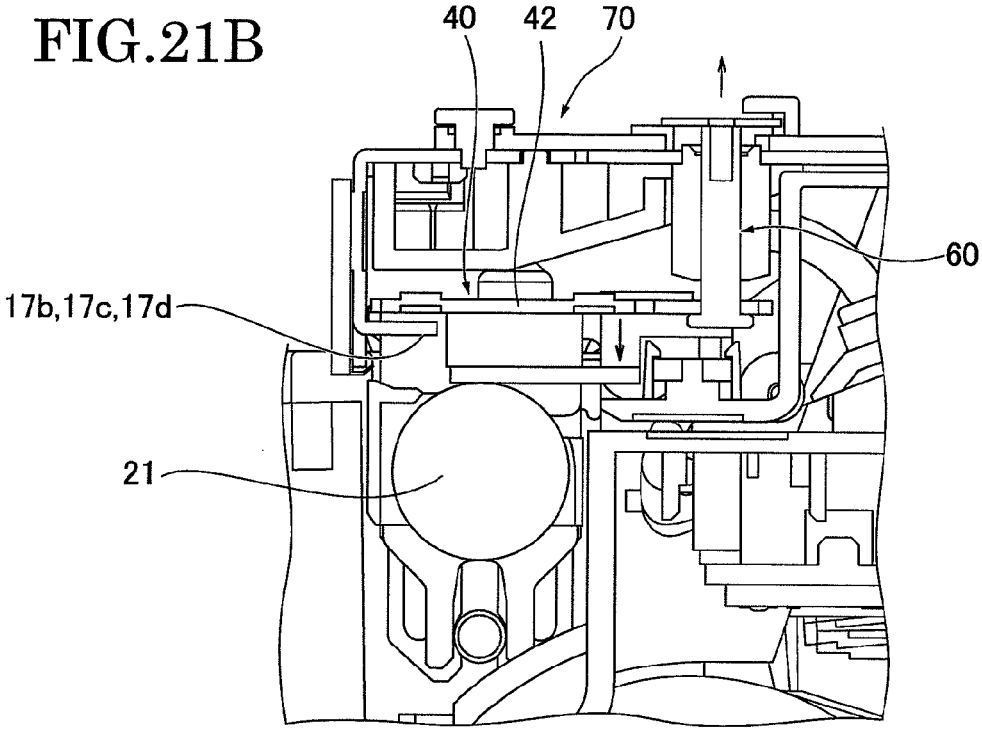

FIGS. 21A, 21B are perspective views showing the relation among the platen roller 21, thermal printhead unit 40, claws 17*b*, 17*c*, 17*d*, stepped pin 60, and stepped pin adjuster element 70. FIG. 21A shows that the right side (upstream side of the forwarding direction of the thermal paper 200) of the thermal printhead unit 40 is inclined downward by the stepped pin adjuster element 70 shown in FIGS. 13A to 13C, and FIG. 21B shows that the same is inclined upward by the stepped pin adjuster element 70 shown in FIGS. 12A to 12C.

Figure 22A:
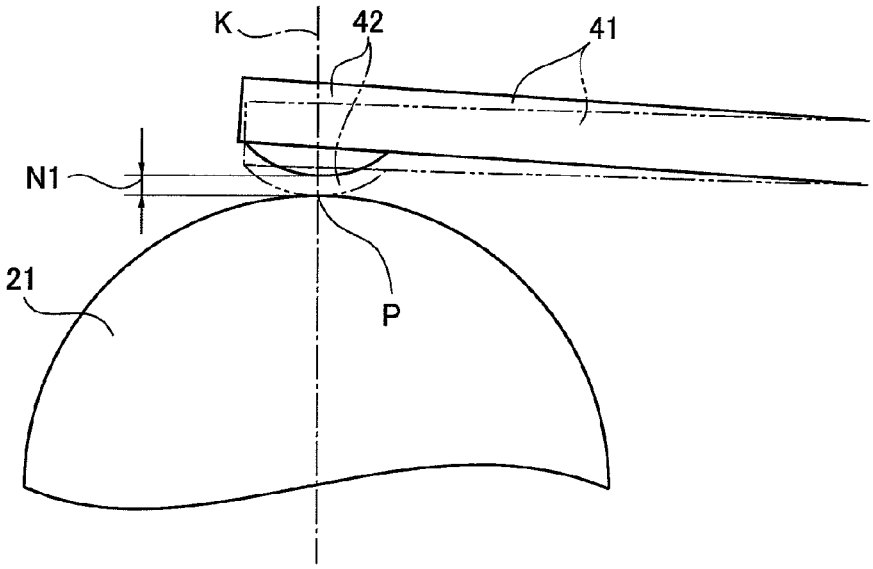
FIG. 22A shows how the thermal printhead unit is inclined when a thick thermal paper enters into a contact point between the exothermic element array and the platen roller.
Figure 22B:
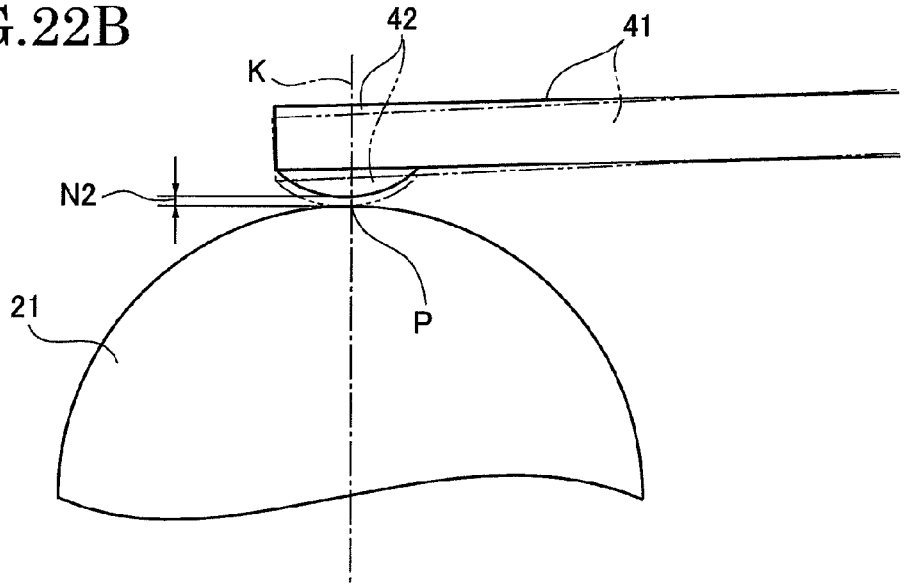
FIG. 22B shows the same when a thin thermal paper enters into the contact point.

FIG. 22A, 22B show in detail the positional relation between the platen roller 21 and the exothermic element array 42 of the thermal printhead 41 of FIGS. 21A, 21B, respectively.

As described above, the two protrusions 46 of the thermal printhead unit 40 are provided on the extension line of the exothermic element array 42 and the positioning notches 22*i*, 23*i* engaging with the protrusions 46 are on the vertical line K passing on the center of the platen roller 21. Accordingly, a contact point P of the platen roller 21 and the exothermic element array 42 is always on the vertical line K irrespective of the inclination of the thermal printhead 41.

In FIG. 22A, when a thick thermal paper 200 (in thickness N1 for example) is delivered between the platen roller 21 and the exothermic element array 42, the thermal printhead unit 40 is inclined upward by the thickness N1 against the bias force of the springs 19*a* to 19*d*. The movement of the thermal printhead unit 40 is the rotation around the notch portion 45 and parallel movement on the vertical line K, as indicated by the double-dashed line in the drawing.

Figure 23A:
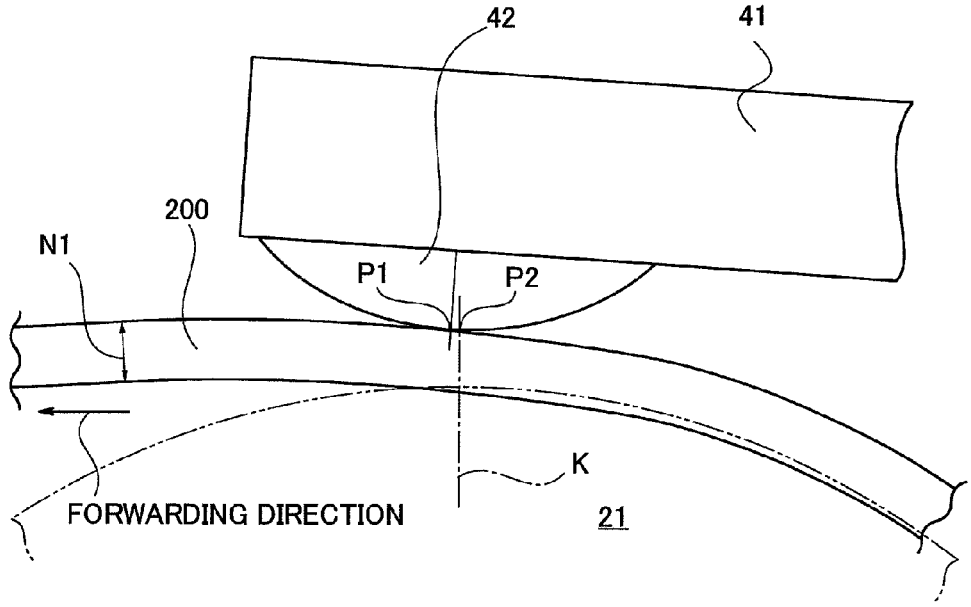
FIG. 23A shows a contact point between the exothermic element array and a paper in detail when the thermal printhead unit is inclined along with a thick thermal paper.

The contact point of the thermal paper 200 and the exothermic element array 42 is a point P2 in FIG. 23A.

Meanwhile, in FIG. 22B, when a thin thermal paper 200 (in thickness N2 (<N1) is delivered between the platen roller 21 and the exothermic element array 42, the thermal printhead unit is inclined upward in the drawing by the thickness N2 against the bias force of the springs 19*a* to 19*d*. The movement of the thermal printhead unit 40 is parallel to the rotation around the notch portion 45 on the vertical line K, as indicated by the double-dashed line in the drawing.

Figure 23B:
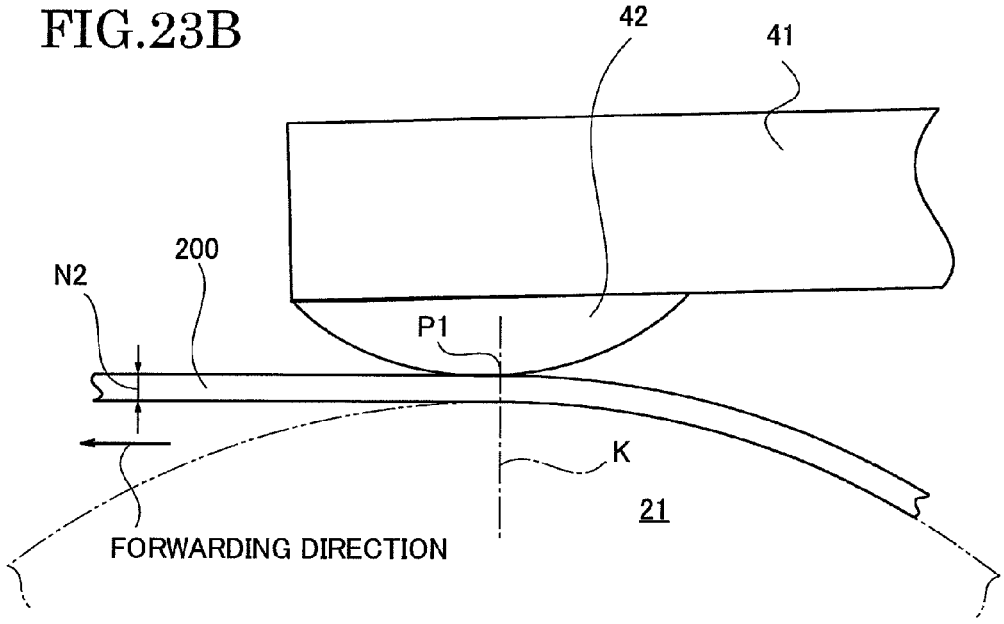
FIG. 23B shows the same when the thermal printhead unit is inclined along with a thin thermal paper.

The contact point of the thermal paper 200 and the exothermic element array 42 is a point P1 in FIG. 23B.

That is, the contact point P2 of the thick thermal paper 200 and the exothermic element array 42 comes more upstream in the forwarding direction of the thermal paper 200 than the contact point P1 of the thin thermal paper 200 and the element array 41.

The thick thermal paper 200 exerts a higher rigidity than the thin thermal paper 200. It is supposed to closely contact with the exothermic element array 42 at the point P2 exactly above the point P as shown in FIG. 23A. However, in reality it is properly brought into close contact at the point P1 more downstream that the point P2 because of the high rigidity. This is because the rigidity of the thick thermal paper 200 causes the elastic circumferential surface of the platen roller 21 to not arc-like but be linearly deformed so that the contact between the paper 200 and the array 42 is weak or the two do not contact at all at the point P2.

Meanwhile, in case of the thin thermal paper 200 with a lower rigidity, it properly closely contacts with the exothermic element array 42 at the point P1 more downstream than the point P2 as shown in FIG. 23B.

Thus, the thermal printer 100 according to the present embodiment is configured that the exothermic element array 42 always contacts with the thermal paper 200 at the same point (P1) properly irrespective of the thickness of the thermal paper 200 so that it can realize high-quality printing irrespective of the thickness of the thermal paper 200

In the thermal printer 100, the thermal printhead 41 and the platen roller 21 are separately structured. Because of this, the thermal paper 200 can be set easily by such a simple operation as closing the cover element 12 (moving it to the closed position).

Moreover, in the thermal printer 100 the thermal printhead unit 40 is manually attachable/detachable to/from the cover frame 17 without any tools; therefore, replacement thereof can be easily done.

Likewise, the platen roller unit 20 is manually attachable/detachable to/from the body frame 18 without any tools; therefore, replacement thereof can be easily done.

According to the present embodiment, the cover element can be opened/closed in various manners such as rotating around the axis in clamshell or linearly moving. Alternatively, it can be configured to be detachable from the body.

The thermal printhead unit can be comprised of at least the exothermic element array in which exothermic elements are arranged along the width of a paper. However, it can also include a head frame such as a bracket or a frame added to the thermal printhead.

Similarly, the platen roller unit can be comprised of at least the platen roller. However, it can also include a bracket or a frame added to the platen roller.

Moreover, the exothermic element array is configured to contact with the platen roller while the cover element is in the closed position. It is preferable to provide a bias element such as a coil spring, a blade spring or other elastic elements between the cover element and the thermal printhead unit, for example, to press the exothermic element array onto the platen roller by a bias force.

The positioning elements of the thermal printhead unit and the platen roller unit are configured to engage with each other to restrict the relative movement of the exothermic element array and the platen roller while the cover element is in the closed position. The supported portion at the front end of the thermal printhead unit is hooked on the claws of the cover element while the notch portion of the back part thereof is hooked on the step portion of the stepped pin. Because of this, the downward movement of the thermal printhead unit is restricted.

Therefore, the positioning elements restrict the relative movement of the exothermic element array and the platen roller in the forwarding direction of the paper but do not restrict their relative rotation and vertical (direction of line connecting the rotary shaft of the platen roller and a contact portion of the exothermic element array and the platen roller) movement.

In other words the exothermic element array is not moved in the paper forwarding direction and can be inclined in an allowable range.

The claws of the cover element can be formed on the cover frame, and the number thereof is preferably plural. Especially, it is preferable to form at least one claw each on both sides from the center of the thermal printhead unit in the width direction in terms of supporting stability.

The stepped pin adjuster element can be formed on the cover frame instead of the cover element.

Further, the position of the step portion adjusted by the stepped pin adjuster element is preset in accordance with a difference in thickness between a plurality of kinds of thermal paper to be used.

A moving direction of the platen roller unit when detached from the body of the thermal printer coincides with a moving direction of the cover element from the closed position. The moving direction of the cover element refers to a moving direction (tangent direction) at a moment when the cover element is moved from the closed position and not to an arc-like direction as a trajectory of a rotating cover element to be in an open position.

The thermal printhead unit is configured to be manually detachable/attachable from the cover element by releasing/engaging the notch portion at the front end from/with the claws and the notch portion at the back part from/with the step portion of the stepped pin. Accordingly, the replacement of the thermal printhead unit can be easily done.

Similarly, the platen roller unit is configured to be detachable/attachable from/to the body by such a simple operation as pulling out the platen roller unit in the moving direction of the cover element from the closed position and pushing it into the cover element in the opposite direction. Accordingly, the replacement of the thermal printhead unit can be easily done.

Furthermore, with the cover element in the closed position, the thermal printhead unit and the platen roller unit are restricted to move in a certain direction only by the engagement of their respective positioning elements, so that the positions of the platen roller and the exothermic element array are maintained in a certain range.

The front and back ends (supported portion and notch portion) of the thermal printhead unit are hooked on the claws of the cover element and the step portion of the stepped pin respectively, so that the thermal printhead unit is vertically inclinable in the front-back direction. The center of the inclination is at the positioning elements engaging with each other, and different from the contact portion of the platen roller and the exothermic element array. Because of this, the position of the exothermic element array contacting with the platen roller changes along with a degree of the inclination.

Then, the inclination of the thermal printhead unit is changed by adjusting the position of the step portion with the stepped pin adjuster element to vertically move the notch portion of the thermal printhead unit hooked on the step portion.

Specifically, with use of the thick thermal paper, the back part of the thermal printhead unit is inclined downward by the stepped pin adjuster element. With use of the thin thermal paper, the back part thereof is inclined upward.

Since the center of the inclination of the thermal printhead unit is at the positioning element in front of the notch portion, with a decrease in height of the back part of the thermal printhead unit, a contacting portion of the exothermic element array with the platen roller is shifted backward compared to the back part in a higher position.

Moreover, when the thick thermal paper enters between the platen roller and the exothermic element array, the thermal printhead unit is moved up via the positioning elements by the thickness of the thermal paper. The movement occurs from the back end (notch portion) thereof; therefore, the front end thereof is further inclined upward, shifting the contact portion of the exothermic element array with the paper backward.

Meanwhile, with use of the thin thermal paper, the inclination of the thermal printhead unit is adjusted by the stepped pin adjuster element so that the back part thereof is inclined upward. When the thin thermal paper enters between the platen roller and the exothermic element array, therefore, the thermal printhead unit is moved up by the thickness of the paper but the contact portion of the exothermic element array is not shifted backward.

According to the thermal printer in the present embodiment, the contact portion of the exothermic element array with the thick paper is shifted backward than with the thin paper.

Generally, the thick paper has a higher rigidity than the thin paper, and is resistant to deflection. Therefore, a contact pressure of the exothermic element array and the paper at an aimed position tends to be lower than expected and it is not enough to perform high-quality printing.

However, the thermal printer in the present embodiment is configured that the exothermic element array is set to first contact with the thick paper at a position more backward than with the thin paper. Due to the high rigidity of the thick paper, the contact position is shifted forward, and the exothermic element array properly contacts with the paper at an appropriate position. Accordingly, high-quality printing is realized at the appropriate position.

Moreover, the position of the exothermic element array first contacting with the paper does not change according to the thickness of the paper. Accordingly, high-quality printing is achievable irrespective of the thickness of the paper in use.

Furthermore, in the thermal printer in the present embodiment, the platen roller unit is attached to the body by the engagement of the bearing and the notch portion. However, the rotation of the entire platen roller unit cannot be restricted only by this engagement of the bearing and the notch portion.

However, the platen roller of the platen roller unit comprises the roller support elements including boss notches and legs and the body comprises bosses exactly below the roller notches to hold the bosses with the legs. It is therefore made possible to restrict the rotation of the entire platen roller unit and maintain the posture of the platen roller unit stably.

As described above, the thermal printer according to the present embodiment comprises the cover element including the thermal printhead unit and the body including the platen roller unit. Thus, the thermal printhead unit and the platen roller are separately structured and manually detachable from the cover element and the body without any tool, respectively. Furthermore, the paper and exothermic element array are properly made in close contact with each other according to the thickness of the paper by the stepped pin adjuster element's changing the position of the stepped pin to change the posture of the thermal printhead unit hooked on the stepped pin.

Although the present invention has been described in terms of exemplary embodiments, it is not limited thereto. It should be appreciated that variations or modifications may be made in the embodiments described by persons skilled in the art without departing from the scope of the present invention as defined by the following claims.

What is claimed is:

1. A thermal printer comprising:

a body comprising a platen roller unit including a platen roller; and a cover element being movable relative to the body between an open position and a closed position, comprising a thermal printhead unit, a claw protruding backward, a stepped pin extending downward, including a step portion at a bottom end, and a stepped pin adjuster element moving the stepped pin in an axial direction to change a position of the step portion, the thermal printhead unit including an exothermic element array, a supported portion in a portion in front of the exothermic element array to be hooked on the claw, and a notch portion at about a center of a width direction of a portion behind the exothermic element array to be hooked on the step portion of the stepped pin, wherein:

the platen roller unit and the thermal printhead unit are placed in the body and the cover element, respectively so that the exothermic element array contacts with the platen roller while the cover element is in the closed position and the exothermic element array and the platen roller are separated from each other while the cover element is not in the closed position;

the platen roller unit and the thermal printhead unit include respective positioning elements which engage with each other to restrict a relative movement of the exothermic element array and the platen roller while the cover element is in the closed position; and the platen roller unit is configured to be detachable from the body in a direction coinciding with a moving direction of the cover element from the closed position.

2. A thermal printer according to claim 1, wherein the stepped pin adjuster element includes a long opening through which the stepped pin is inserted, and is a movable adjuster configured to be relatively movable in an extending direction of the long opening with the stepped pin inserted;

an edge of the long opening is configured to be a cam whose thickness is uneven in a moving range of the movable adjuster; and a top end of the stepped pin protrudes from the long opening and includes a large diameter portion whose diameter is larger than an outer diameter of the stepped pin and which is hooked on the edge of the long opening.

3. A thermal printer according to claim 1, wherein a length of the notch portion is longer than a length of an engaging portion of the claw and the supported portion in a front-back direction.

4. A thermal printer according to claim 1, wherein:

the platen roller includes a rotary shaft configured to protrude from both ends of the platen roller, and the platen roller unit includes bearings around the protruding portions of the rotary shaft to rotatably support the rotary shaft;

the body comprises, on both sides, roller notches each configured to have a width equal to an outer diameter of the bearings or slightly larger than a diameter of the rotary shaft, extend downward, and have an open top end; and the platen roller is attached to the body by engagement of the roller notches with the bearings.

5. A thermal printer according to claim 4, wherein:

the body comprises bosses immediately below the roller notches, respectively;

the platen roller unit comprises, on both sides of the platen roller, roller support elements through which the rotary shaft penetrates, respectively;

the roller support elements each comprise leg portions holding the boss therebetween by an elastic force while the rotary shaft is engaged with the roller notch, a boss notch vertically extending and having a width equal to or slightly larger than an outer diameter of the boss to contact with an outer circumference of the boss; and the roller support elements are each configured to hold the boss between the leg portions with the boss fitted in the boss notch.

6. A thermal printer according to claim 5, wherein the leg portions are made of an elastic resin element and the boss notches are made of a metal element with a higher rigidity than that of the resin element.

* * * * *